US010792932B2

(12) United States Patent
Sawamura et al.

(10) Patent No.: US 10,792,932 B2
(45) Date of Patent: Oct. 6, 2020

(54) IMAGE RECORDING APPARATUS AND IMAGE RECORDING METHOD

(71) Applicant: Ricoh Company, Ltd., Tokyo (JP)

(72) Inventors: Ichiro Sawamura, Shizuoka (JP); Yoshihiko Hotta, Shizuoka (JP); Kazuyuki Uetake, Shizuoka (JP); Takahiro Furukawa, Kanagawa (JP); Tomomi Ishimi, Shizuoka (JP); Yasuroh Yokota, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/051,932

(22) Filed: Aug. 1, 2018

(65) Prior Publication Data

US 2018/0339524 A1 Nov. 29, 2018

Related U.S. Application Data

(63) Continuation of application No. PCT/JP2017/004125, filed on Feb. 3, 2017.

(30) Foreign Application Priority Data

Feb. 5, 2016 (JP) ..... 2016-021354
Feb. 3, 2017 (JP) ..... 2017-018471

(51) Int. Cl.
*B41J 2/447* (2006.01)
*B41J 2/475* (2006.01)
*B41J 2/46* (2006.01)

(52) U.S. Cl.
CPC ..... *B41J 2/4753* (2013.01); *B41J 2/447* (2013.01); *B41J 2/46* (2013.01); *B41J 2/475* (2013.01)

(58) Field of Classification Search
CPC ... B41J 2/435; B41J 2/442; B41J 2/447; B41J 2/45; B41J 2/451; B41J 2/455; B41J 2/46;
(Continued)

(56) References Cited

U.S. PATENT DOCUMENTS 6,562,413 B1 5/2003 Morgavi
7,439,993 B2 10/2008 Ishimi et al.
(Continued)

FOREIGN PATENT DOCUMENTS

CN 1260753 A 7/2007
CN 101037064 A 9/2007
(Continued)

OTHER PUBLICATIONS

Morikawa, MachineTranslationofJP2002-273922A, 2002 (Year: 2002).*
(Continued)

*Primary Examiner* — Scott A Richmond
(74) *Attorney, Agent, or Firm* — Xsensus LLP

(57) ABSTRACT

An image recording apparatus that irradiates a recording target with laser light and records an image thereon, that includes: a laser irradiation device that has plural laser emitting elements, and irradiates the recording target with laser light emitted from the plural laser emitting elements; an irradiation condition adjusting unit that causes the laser irradiation device to emit laser light such that a part of an image dot recorded on the recording target moving relatively to the laser irradiation device overlaps an image dot adjacent thereto, and makes a laser irradiation condition for when image dots forming a boundary between a colored portion and a non-colored portion are recorded, different from a laser irradiation condition for when the other image dots are recorded; and an output control unit that controls the irradiation with the laser light, based on the laser irradiation
(Continued)

condition adjusted by the irradiation condition adjusting unit.

12 Claims, 15 Drawing Sheets

(58) Field of Classification Search
CPC ..... B41J 2/465; B41J 2/47; B41J 2/471; B41J 2/473; B41J 2/475; B41J 2/36; B41J 2/362
See application file for complete search history.

(56) References Cited

U.S. PATENT DOCUMENTS

| | | | |
|---|---|---|---|
| 8,284,226 | B2 | 10/2012 | Hasegawa et al. |
| 8,546,300 | B2 | 10/2013 | Uchimura |
| 9,757,956 | B2 | 9/2017 | Ishimi et al. |
| 2002/0015088 | A1 | 2/2002 | Inoue et al. |
| 2007/0268356 | A1 | 11/2007 | Murakami et al. |
| 2007/0285488 | A1 | 12/2007 | Ishimi et al. |
| 2010/0039916 | A1 | 2/2010 | Hasegawa et al. |
| 2011/0090299 | A1 | 4/2011 | Asai et al. |
| 2011/0177941 | A1 | 7/2011 | Uchimura et al. |
| 2012/0188328 | A1 | 7/2012 | Takezawa |
| 2016/0263928 | A1* | 9/2016 | Costin, Jr. ..... B41J 2/455 |
| 2016/0279968 | A1 | 9/2016 | Ishimi et al. |

FOREIGN PATENT DOCUMENTS

| | | | | |
|---|---|---|---|---|
| CN | 101073953 | A | | 11/2007 |
| CN | 101648467 | A | | 2/2010 |
| CN | 102152681 | A | | 8/2011 |
| CN | 105050819 | A | | 11/2015 |
| EP | 0060641 | A2 | | 9/1982 |
| JP | S58148777 | A | | 9/1983 |
| JP | 06-234227 | | | 8/1994 |
| JP | H7186445 | A | | 7/1995 |
| JP | 09-118029 | | | 5/1997 |
| JP | 2000-190546 | | | 7/2000 |
| JP | 2002-273922 | | | 9/2002 |
| JP | 2002273922 | A | * | 9/2002 |
| JP | 2010-052350 | | | 3/2010 |
| JP | 2011-025647 | | | 2/2011 |
| JP | 2011-031462 | | | 2/2011 |
| JP | 2011-104994 | | | 6/2011 |

OTHER PUBLICATIONS

International Search Report dated Apr. 11, 2017 in PCT/JP2017/004125 filed on Feb. 3, 2017.
Written Opinion dated Apr. 11, 2017 in PCT/JP2017/004125 filed on Feb. 3, 2017.
Notification of First Office Action dated Apr. 25, 2019, issued in corresponding Chinese Application No. 201780009510.7, 21 pages (with English translation).

* cited by examiner

IMAGE RECORDING APPARATUS AND IMAGE RECORDING METHOD

CROSS-REFERENCE TO RELATED APPLICATIONS

This application is a continuation of PCT international application Ser. No. PCT/JP2017/004125 filed on Feb. 3, 2017 which designates the United States, incorporated herein by reference, and which claims the benefit of priority from Japanese Patent Applications No. 2016-021354, filed on Feb. 5, 2016 and Japanese Patent Applications No. 2017-018471, filed on Feb. 3, 2017, incorporated herein by reference.

BACKGROUND OF THE INVENTION

1. Field of the Invention

Embodiments relate to an image recording apparatus and an image recording method.

2. Description of the Related Art

Image recording apparatuses, which record visible images on recording targets by heating the recording targets through irradiation of the recording targets with laser light, have been known conventionally.

Described as one of these image recording apparatuses, for example, in Japanese Unexamined Patent Application Publication No. 2010-052350, is an image recording apparatus including a laser irradiation device, such as a laser array, which has plural semiconductor lasers serving as laser emitting elements arranged in an array, and which irradiates positions that are different from one another in a predetermined direction, with laser light emitted from the semiconductor lasers. This image recording apparatus described in Japanese Unexamined Patent Application Publication No. 2010-052350 records a visible image on a recording target by irradiating the recording target, which moves relatively to the laser irradiation device in a direction orthogonal to the predetermined direction, with laser.

However, the image recording apparatus described in Japanese Unexamined Patent Application Publication No. 2010-052350 has a problem that: outlined images formed on recording targets are crushed, or so-called image thickening where images recorded on recording targets are formed more largely than those of their image data is caused; and thus recording of high-quality images is not possible.

In view of the above, there is a need to provide an image recording apparatus and an image recording method, which enable edges of colored portions to be smoothed, and image fattening and crushing of outlined images to be prevented.

SUMMARY OF THE INVENTION

In order to solve the conventional problem, the present invention provides an image recording apparatus that irradiates a recording target with laser light and records an image thereon. The image recording apparatus includes a laser irradiation device, an irradiation condition adjusting unit, and an output control unit. The laser irradiation device has plural laser emitting elements, and is configured to irradiate the recording target with laser light emitted from the plural laser emitting elements. The irradiation condition adjusting unit is configured to cause the laser irradiation device to emit laser light such that a part of an image dot recorded on the recording target moving relatively to the laser irradiation device overlaps an image dot adjacent thereto, and is configured to make a laser irradiation condition for when image dots forming a boundary between a colored portion and a non-colored portion are recorded, different from a laser irradiation condition for when the other image dots are recorded. The output control unit is configured to control the irradiation with laser light by the laser irradiation device, based on the laser irradiation condition adjusted by the irradiation condition adjusting unit.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
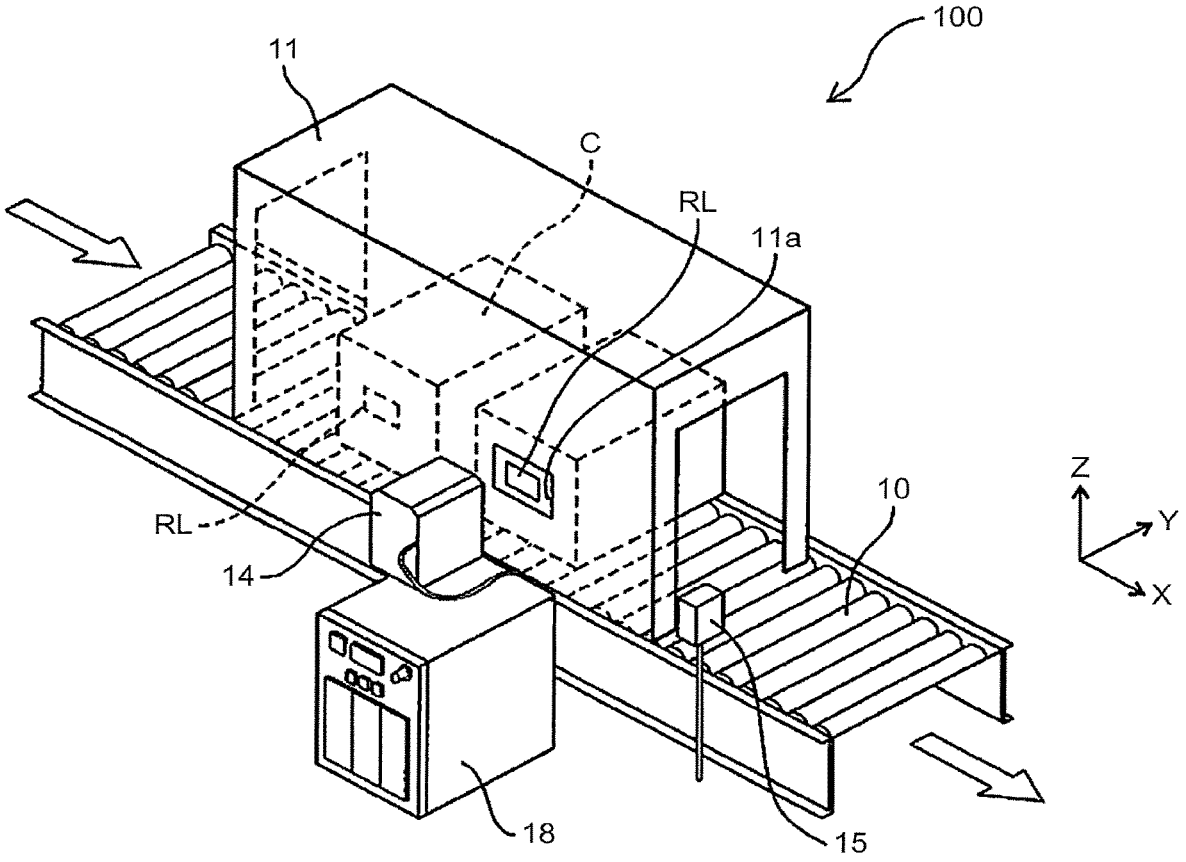
FIG. 1 is a schematic perspective view of an image recording system according to an embodiment.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

Hereinafter, embodiments of an image recording apparatus and an image recording method, to which the present invention has been applied, will be described. The image recording apparatus executes recording of an image by irradiating a recording target with laser light.

The image is not particularly limited, and thus may be any visually recognizable information and may be selected appropriately according to the purpose. The image may be, for example, a character, a symbol, a line, a figure, a solid image, a combination of any of these, or a two-dimensional code, such as a bar code or a QR code (registered trademark).

Further, the recording target is not particularly limited, and thus may be anything recordable with laser and may be selected appropriately according to the purpose. The recording target may be anything that is able to absorb light, converts the light into heat, and forms an image, and for example, engraving on metal is included. Further, the recording target may be a thermosensitive recording medium, a structure having a thermosensitive recording portion, or the like.

The thermosensitive recording medium has a support, and an image recording layer on the support, and further has, as necessary, one or more other layers. Each of these layers may have a single layer structure, or a layered structure, and may be on the other side of the support.

Image Recording Layer

The image recording layer contains a leuco dye and a developer, and further contains one or more other components as necessary.

The leuco dye is not particularly limited, and may be selected appropriately, according to the purpose, from leuco dyes normally used in thermosensitive recording materials. For example, as the leuco dye, a leuco compound of: a triphenylmethane dye; a fluoran dye; a phenothiazine dye; an auramine dye; a spiropyran dye; an indolinophthalide dye; or the like, is preferably used.

Any of various electron-accepting compounds or oxidizing agents, which develop color of the leuco dye upon contact, may be used.

The other component may be a binder resin, a photothermal converting material, a thermofusible substance, an antioxidant, a photostabilizer, a surfactant, a lubricant, a filler, or the like.

Support

The shape, structure, size, and the like of the support are not particularly limited, and may be selected appropriately according to the purpose. The shape may be, for example, a flat plate shape. The structure may be a single layer structure, or a layered structure. The size may be selected appropriately, according to a size or the like of the thermosensitive recording medium.

Other Layer

The other layer may be a photothermal converting layer, a protective layer, an under layer, an ultraviolet absorption layer, an oxygen blocking layer, an intermediate layer, a back layer, an adhesive layer, a pressure sensitive adhesive, or the like.

The thermosensitive recording medium may be processed into a desired shape according to its use. This shape may be, for example, a card shape, a tag shape, a label shape, a sheet shape, a roll shape, or the like. The thermosensitive recording medium processed into the card shape may be for example, a prepaid card, a point card, a credit card, or the like. The thermosensitive recording medium processed into a tag-shaped size smaller than a card size may be used for a price tag, or the like. Further, the thermosensitive recording medium processed into a tag-shaped size larger than the card size may be used for process control, shipping instructions, a ticket, or the like. Since the thermosensitive recording medium processed into the label shape is able to be pasted, this thermosensitive recording medium is able to be used in process control, goods management, or the like, by being processed into any of various sizes, and being pasted on a handcart, a case, a box, a container, or the like, which is repeatedly used. Further, the thermosensitive recording medium processed into a sheet size larger than the card size has a wider range for recording of an image, and thus is able to be used for a general document, instructions for process management, or the like.

The thermosensitive recording portion that the structure has may be, for example: a portion where the label shaped thermosensitive recording medium has been pasted on a surface of the structure; a portion where a thermosensitive recording material has been coated on a surface of the structure; or the like. Further, the structure having the thermosensitive recording portion is not particularly limited, and thus may be any structure having the thermosensitive recording portion on a surface of the structure and may be selected appropriately according to the purpose. The structure having the thermosensitive recording portion may be, for example: any of various products, such as plastic bags, PET bottles, and canned food; a conveyance case, such as cardboard or a container; a product in progress; an industrial product; or the like.

Hereinafter, as an example, an image recording apparatus, which records an image on a recording target that is a structure having a thermosensitive recording portion, will be described, the recording target specifically being a container C for transport having a thermosensitive recording label pasted thereon.

FIG. 1 is a schematic perspective view of an image recording system 100 serving as an image recording apparatus according to an embodiment. In the following description, a conveyance direction of the container C for transport will be referred to as an X-axis direction, an up-down direction as a Z-axis direction, and a direction orthogonal to both the conveyance direction and the up-down direction as a Y-axis direction.

The image recording system 100 executes recording of an image by irradiating a thermosensitive recording label RL pasted on the container C for transport serving as a recording target, with laser light.

The image recording system 100 includes, as illustrated in FIG. 1: a conveyor device 10 serving as a recording target conveying means; a recording device 14; a system control device 18; a reading device 15; a shielding cover 11; and the like.

The recording device 14 records an image that is a visible image, on the recording target, by irradiating the recording target with laser light, and corresponds to a laser irradiation device. The recording device 14 is arranged on a −Y side of the conveyor device 10, that is, on the −Y side of a conveyance path.

The shielding cover 11 reduces diffusion of laser light by shielding the laser light emitted from the recording device 14, and has black almite coated on a surface of the shielding cover 11. In a portion of the shielding cover 11, the portion facing the recording device 14, an opening 11*a* for passage of laser light therethrough is provided. Further, in this embodiment, the conveyor device 10 is a roller conveyor, but the conveyor device 10 may be a belt conveyor.

The conveyor device 10, the recording device 14, the reading device 15, and the like are connected to the system control device 18, which controls the whole image recording system 100. Further, as described later, the reading device 15 reads a code image, such as a two-dimensional code, like a bar code or a QR code, which has been recorded on the recording target. The system control device 18 executes, based on information read by the reading device 15, collation of whether or not a correct image has been recorded.

The thermosensitive recording label RL pasted on the container C will now be described.

The thermosensitive recording label RL is a thermosensitive recording medium, and an image is recorded thereon through change of color tone by heat. In this embodiment, a thermosensitive recording medium, on which image recording is executed once, is used, but a thermoreversible recording medium, on which recording is able to be executed a plural number of times, may be used as the thermosensitive recording label RL.

The thermosensitive recording medium to be used as the thermosensitive recording label RL used in this embodiment is a thermosensitive recording medium that contains a material that absorbs laser light and converts the laser light into heat (a photothermal converting material) and a material that is changed in hue, reflectivity, or the like by heat.

Photothermal converting materials may be broadly classified into inorganic materials and organic materials. The inorganic material may be, for example, carbon black, or particles of at least any one of: metal borides; and metallic oxides of Ge, Bi, In, Te, Se, Cr, and the like. The inorganic material is preferably a material that largely absorbs light of a near infrared wavelength region and less absorbs light of a visible wavelength region, and is preferably the metal boride and metallic oxide. The inorganic material is, for example, suitably at least one type selected from: a hexaboride compound; a tungsten oxide compound; an antimony tin oxide (ATO); an indium tin oxide (ITO); and a zinc antimonate.

The hexaboride compound may be, for example, $LaB_6$, $CeB_6$, $PrB_6$, $NdB_6$, $GdB_6$, $TbB_6$, $DyB_6$, $HoB_6$, $YB_6$, $SmB_6$, $EuB_6$, $ErB_6$, $TmB_6$, $YbB_6$, $LuB_6$, $SrB_6$, $CaB_6$, $(La, Ce)B_6$, or the like.

The tungsten oxide compound may be, for example: particles of a tungsten oxide represented by a general formula, WyOz (where W is tungsten, O is oxygen, and $2.2 \leq z/y \leq 2.999$), as described in WO 2005/037932, Japanese Unexamined Patent Application Publication No. 2005-187323, and the like; or particles of a composite tungsten oxide represented by a general formula, MxWyOz (where: M is one or more elements selected from H, He, alkali metals, alkaline earth metals, rare earth elements, Mg, Zr, Cr, Mn, Fe, Ru, Co, Rh, Ir, Ni, Pd, Pt, Cu, Ag, Au, Zn, Cd, Al, Ga, In, Tl, Si, Ge, Sn, Pb, Sb, B, F, P, S, Se, Br, Te, Ti, Nb, V, Mo, Ta, Re, Be, Hf, Os, Bi, and I; W is tungsten; O is oxygen, $0.001 \leq x/y \leq 1$; and $2.2 \leq z/y \leq 3.0$).

Among these, the tungsten oxide compound is preferably a cesium-containing tungsten oxide, in particular, because cesium-containing tungsten oxides have large absorption in the near infrared region and small absorption in the visible region.

Further, among the antimony tin oxide (ATO), the indium tin oxide (ITO), and the zinc antimonate, a material to be used preferably is ITO, in particular, because ITO has large absorption in the near infrared region and small absorption in the visible region. These materials are formed in layers by a vacuum vapor deposition method or adhesion of the particulate material with resin or the like.

Any of various dyes may be appropriately used as the organic material, according to an optical wavelength to be absorbed, but if semiconductor lasers are used as a light source, a near infrared absorbing dye having an absorption peak around 600 nm to 1,200 nm is used. Specifically, the organic material may be a cyanine dye, a quinone dye, a quinoline derivative of indonaphthol, a phenylenediamine nickel complex, a phthalocyanine pigment, or the like.

As the photothermal converting material, one type of photothermal converting materials may be used alone, or two or more types of photothermal converting materials may be used in combination. Further, the photothermal converting material may be provided on the image recording layer or may be provided on a member other than the image recording layer. If the photothermal converting material is used on a member other than the image recording layer, a photothermal converting layer is preferably provided adjacently to a thermoreversible recording medium. The photothermal converting layer contains at least the photothermal converting material and a binder resin.

A known material, such as, for example, a combination of an electron-donating dye precursor and an electron-accepting developer, may be used as a material that is changed in hue, reflectivity, or the like by heat, the combination having been used in conventional thermosensitive paper. Further, examples of the material that is changed in hue, reflectivity, or the like by heat include, for example, a material that undergoes a change, such as a complex reaction between heat and light, for example, metachromasia associated with solid phase polymerization by heating of a diacetylene compound and ultraviolet irradiation.

Figure 2:
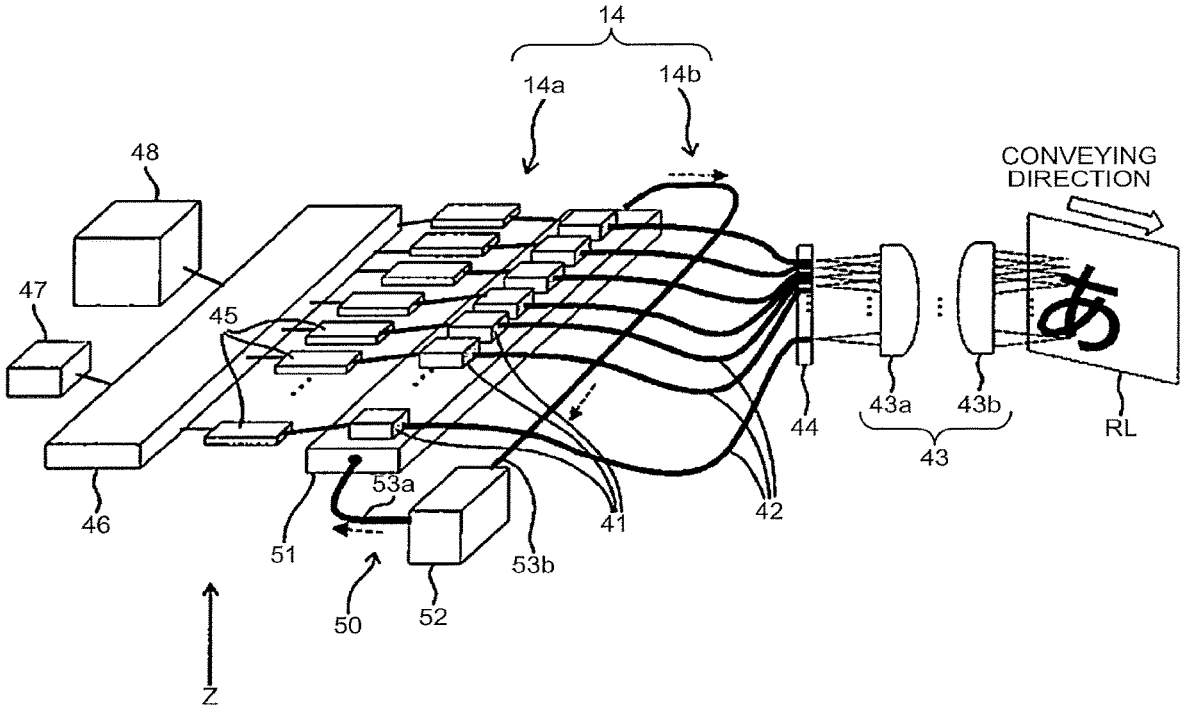
FIG. 2 is a schematic perspective view illustrating a configuration of a recording device.

FIG. 2 is a schematic perspective view illustrating a configuration of the recording device 14.

In this embodiment, a fiber array recording device, which executes recording of an image by using a fiber array having laser emitting portions of plural optical fibers, is used as the recording device 14, the laser emitting portions being arranged in an array in a main scanning direction (Z-axis direction) orthogonal to a sub-scanning direction (X-axis direction) that is a movement direction of the container C serving as the recording target. The fiber array recording device records an image formed of plotting units, by irradiating the recording target with laser light emitted from laser emitting elements via the fiber array. Specifically, the recording device 14 includes a laser array unit 14*a*, a fiber array unit 14*b*, and an optical unit 43.

The laser array unit 14*a* includes: plural laser emitting elements 41 arranged in an array; a cooling unit 50 that cools the laser emitting elements 41; plural drivers 45 that are provided correspondingly to the laser emitting elements 41 and are for driving the corresponding laser emitting elements 41; and a controller 46 that controls the plural drivers 45. A power source 48 for supplying electric power to the laser emitting elements 41, and an image information output unit 47, such as a personal computer, which outputs image information, are connected to the controller 46.

The laser emitting elements 41 may be selected appropriately, according to the purpose, and for example, semiconductor lasers, solid lasers, or dye lasers may be used as the laser emitting elements 41. The laser emitting elements 41 are preferably semiconductor lasers because among these, semiconductor lasers have wide wavelength selectivity, enable downsizing due to their small size, and enable cost reduction.

Further, a wavelength of the laser light emitted by the laser emitting elements 41 is not particularly limited, may thus be selected appropriately, according to the purpose, and is preferably 700 nm to 2000 nm, and more preferably 780 nm to 1600 nm.

In the laser emitting elements 41 serving as an emitting means, not all of energy applied is converted to laser light. Normally, in the laser emitting elements 41, heat is generated by conversion of energy to heat, the energy not having been converted to laser light. Thus, the laser emitting elements 41 are cooled by the cooling unit 50 serving as a cooling means. Further, in the recording device 14 according to this embodiment, by use of the fiber array unit 14*b*, the laser emitting elements 41 are able to be arranged separately from one another. Thereby, influence of heat from any adjacent laser emitting elements 41 is able to be reduced, and cooling of the laser emitting elements 41 is able to be performed efficiently; and thus temperature increase and variation in the laser emitting elements 41 are able to be avoided, output variation of laser light is able to be reduced, and density unevenness and formation of voids are able to be improved. An output of laser light is the average output measured by a power meter. There are two types of laser light output control methods, the two types being a method where the peak power is controlled, and a method where the pulse emission ratio (duty: laser emission time/cycle time) is controlled.

The cooling unit 50 is of a liquid cooling type that cools the laser emitting elements 41 by circulating a liquid coolant, and includes: a heat receiving unit 51, in which the liquid coolant receives heat from the laser emitting elements 41; and a heat releasing unit 52 that releases heat of the liquid coolant. The heat receiving unit 51 and the heat releasing unit 52 are connected by cooling pipes 53*a* and 53*b*. The heat receiving unit 51 has a cooling tube provided inside a case formed of a highly thermally conductive member, the cooling tube being formed of a highly thermally conductive member and being for flow of the liquid coolant therethrough. The plural laser emitting elements 41 are arranged in an array on the heat receiving unit 51.

The heat releasing unit 52 includes a radiator, and a pump for circulating the liquid coolant. The liquid coolant sent out by the pump of the heat releasing unit 52 goes through the cooling pipe 53*a*, and flows into the heat receiving unit 51. While moving in the cooling tube inside the heat receiving unit 51, the liquid coolant cools the laser emitting elements 41 by taking over the heat in the laser emitting elements 41 arranged on the heat receiving unit 51. The liquid coolant that has flown out from the heat receiving unit 51 and has increased in temperature by taking over the heat in the laser emitting elements 41 moves in the cooling pipe 53*b*, flows into the radiator of the heat releasing unit 52, and is cooled by the radiator. The liquid coolant that has been cooled by the radiator is sent out to the heat receiving unit 51 again by the pump.

The fiber array unit 14*b* includes: plural optical fibers 42 provided correspondingly to the laser emitting elements 41; and an array head 44 that holds portions around laser emitting portions 42*a* (see FIG. 3B) of these optical fibers 42 in an array in the up-down direction (Z-axis direction). Laser entering portions of the optical fibers 42 are attached to laser emitting surfaces of their corresponding laser emitting elements 41.

Figure 3A:
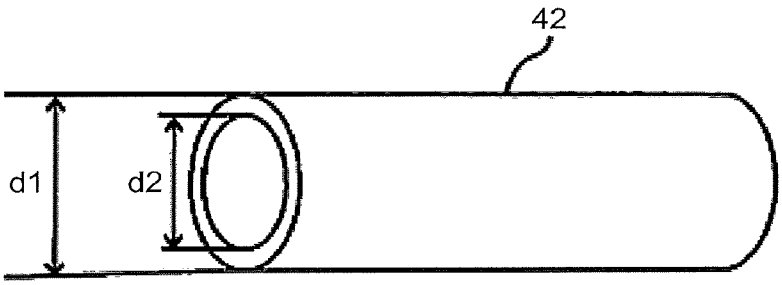
FIG. 3A is an enlarged schematic view of an optical fiber 42.
Figure 3B:
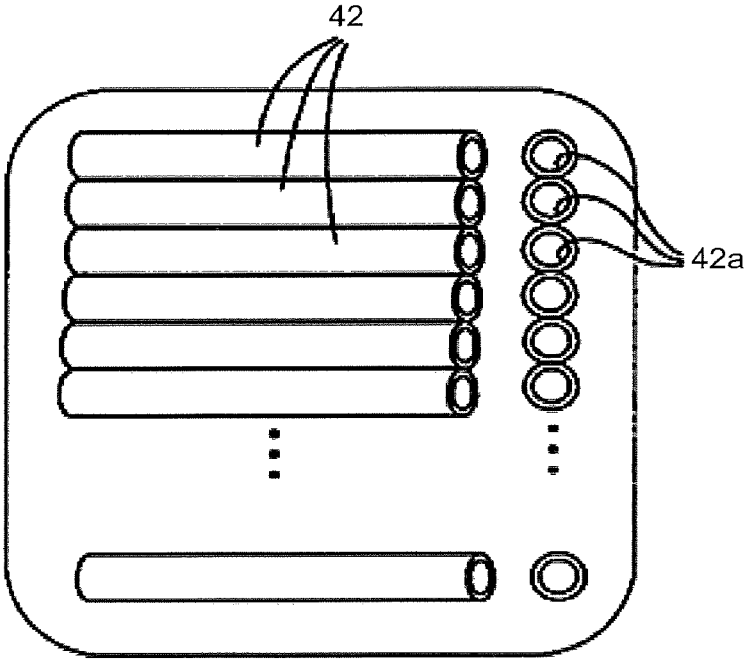
FIG. 3B is an enlarged view around array heads.

FIG. 3A is an enlarged schematic view of an optical fiber 42. FIG. 3B is an enlarged view around the array head 44.

The optical fibers 42 are optical waveguides for laser light emitted from the laser emitting elements 41. The shape, size (diameter), material, structure, and the like of the optical fibers 42 are not particularly limited, and may be selected appropriately, according to the purpose.

The size (diameter d1) of each optical fiber 42 is preferably equal to or larger than 15 μm and equal to or less than 1000 μm. The diameter d1 of the optical fiber 42 being equal to or larger than 15 μm and equal to or less than 1000 μm is advantageous in terms of image definition. In this embodiment, optical fibers each having a diameter of 125 μm are used as the optical fibers 42.

Further, the material of the optical fiber 42 is not particularly limited; may be selected, appropriately, according to the purpose; and may be, for example, glass, resin, or quartz.

The structure of the optical fiber 42 is preferably a structure formed of: a central core portion that passes laser light therethrough; and a cladding layer provided on the outer periphery of the core portion.

A diameter d2 of the core portion is not particularly limited; may be selected appropriately, according to the purpose; and is preferably equal to or larger than 10 μm and equal to or less than 500 μm. In this embodiment, an optical fiber having a core portion with the diameter d2 of 105 μm is used. Further, the material of the core portion is not particularly limited; may be selected appropriately, according to the purpose; and may be, for example, glass doped with germanium or phosphorus.

The average thickness of the cladding layer is not particularly limited; may be selected appropriately, according to the purpose; and is preferably equal to or larger than 10 μm and equal to or less than 250 μm. The material of the cladding layer is not particularly limited, and may be selected appropriately, according to the purpose. The material of the cladding layer may be, for example, glass doped with boron or fluorine.

As illustrated in FIG. 3B, the portions around the laser emitting portions 42*a* of the plural optical fibers 42 are held in an array by the array head 44, such that a pitch of the laser emitting portions 42*a* of the optical fibers 42 becomes 127 μm. In the recording device 14, the pitch of the laser emitting portions 42*a* is set at 127 μm so as to enable recording of an image having a resolution of 200 dpi.

If all of the optical fibers 42 are attempted to be held by one array head 44, the array head 44 becomes too long and easy to be deformed. As a result, it is difficult for one array head 44 to keep linearity of the beam array and uniformity of the beam pitch. Therefore, the number of optical fibers 42 held by the array head 44 is 100 to 200. In addition, in the recording device 14, plural array heads 44 each holding 100 to 200 optical fibers 42 are preferably arranged in a line in the Z-axis direction that is the direction orthogonal to the conveyance direction of the container C. In this embodiment, 200 array heads 44 are arranged in a line in the Z-axis direction.

FIG. 4A to FIG. 4E are diagrams illustrating examples of arrangement of the array heads 44.

Figure 4A:
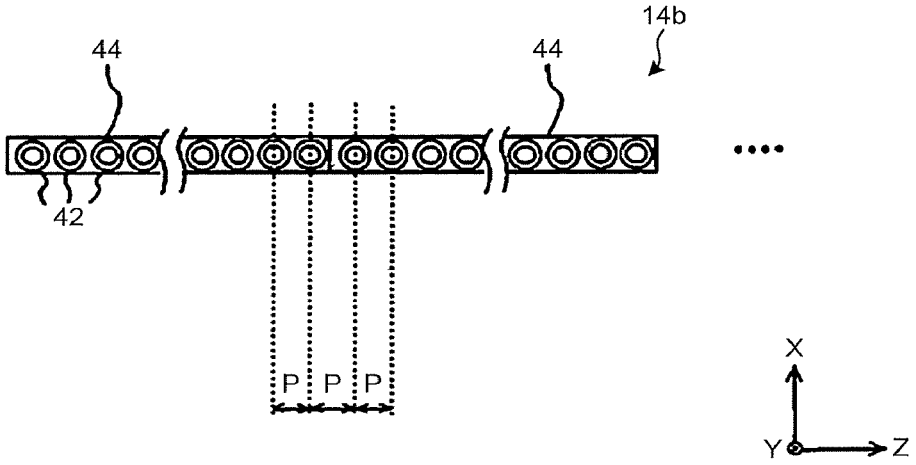
FIG. 4A is a diagram illustrating an example of arrangement of array heads.
Figure 4B:
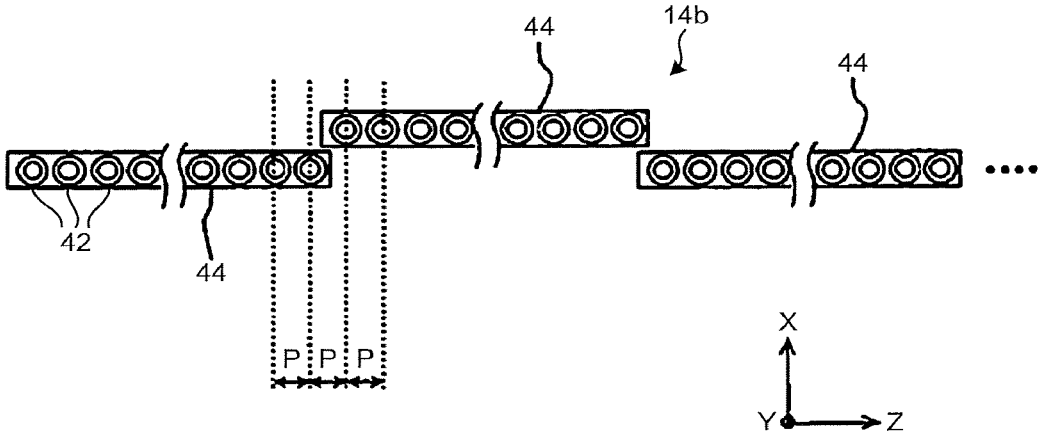
FIG. 4B is a diagram illustrating an example of the arrangement of the array heads.

FIG. 4A is an example where the plural array heads 44 of the fiber array unit 14*b* in the recording device 14 are arranged in an array in the Z-axis direction. FIG. 4B is an example where the plural array heads 44 of the fiber array unit 14*b* in the recording device 14 are arranged in a zigzag.

The arrangement of the plural array heads 44 is preferably the zigzag arrangement as illustrated in FIG. 4B in terms of assembly, rather than a linear arrangement in the Z-axis direction as illustrated in FIG. 4A.

Figure 4C:
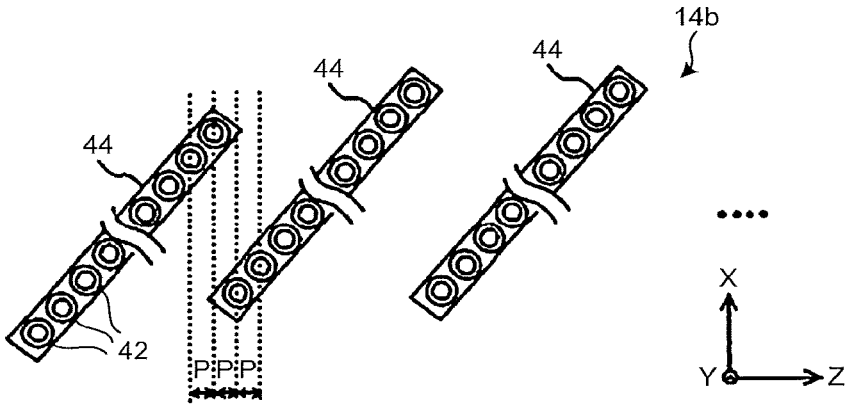
FIG. 4C is a diagram illustrating an example of the arrangement of the array heads.

Further, FIG. 4C is an example where the plural array heads 44 of the fiber array unit 14*b* in the recording device 14 are arranged inclinedly with respect to the X-axis direction. By the arrangement of the plural array heads 44 as illustrated in FIG. 4C, a Z-axis direction pitch P of the optical fibers 42 is able to be made narrower than those of the arrangements illustrated in FIG. 4A and FIG. 4B, and thus the resolution is able to be increased.

Figure 4D:
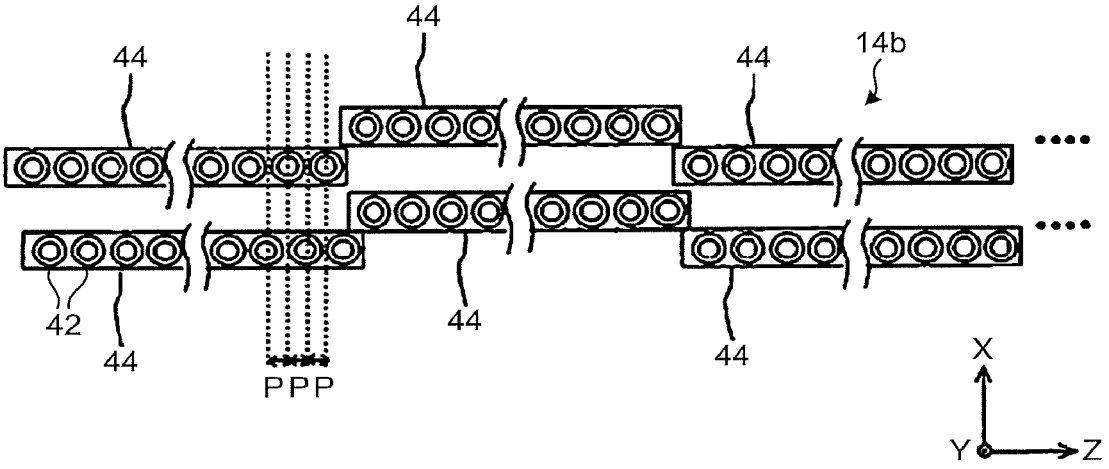
FIG. 4D is a diagram illustrating an example of the arrangement of the array heads.

Further, FIG. 4D is an example where two array head groups are arranged in the sub-scanning direction (X-axis direction), each of the two array head groups having the plural array heads 44 of the fiber array unit 14*b* in the recording device 14, the plural array heads 44 being arranged in a zigzag, one of the array head groups being arranged to be shifted by a half of an arrangement pitch of the optical fibers 42 of the array heads 44 in the main scanning direction (Z-axis direction) with respect to the other array head group. By the arrangement of the plural array heads 44 as illustrated in FIG. 4D, the Z-axis direction pitch P of the optical fibers 42 is able to be made narrower than those in the arrangements illustrated in FIG. 4A and FIG. 4B, and thus the resolution is able to be increased.

The recording device 14 according to this embodiment executes recording, according to control by the system control device 18, by transmitting image information that is in a direction orthogonal to a scanning direction of the thermosensitive recording label RL pasted on the container C for transport serving as the recording target. Therefore, since the recording device 14 accumulates the image information in a memory if there is a difference between the time of scanning of the thermosensitive recording label RL and the time of transmission of the image information in the orthogonal direction, the amount of image accumulated is increased. In that case, the example of the arrangement of the plural array heads 44 illustrated in FIG. 4D enables reduction of the amount of accumulated information in the memory of the system control device 18 more than the example of the arrangement of the plural array heads 44 illustrated in FIG. 4C.

Figure 4E:
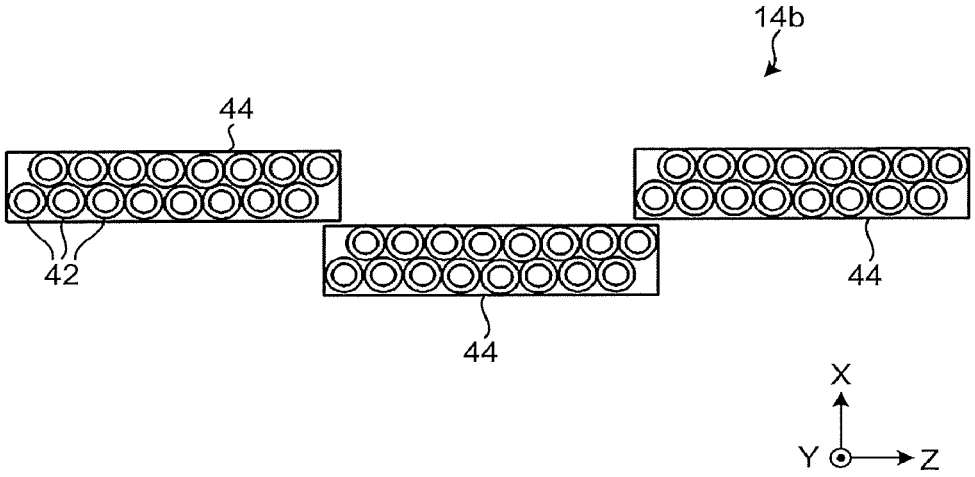
FIG. 4E is a diagram illustrating an example of the arrangement of the array heads.

Further, FIG. 4E is an example where the two array head groups, which are illustrated in FIG. 4D, and each of which has the plural array heads 44 arranged in a zigzag, are layered over each other as a single array head group. Such array heads 44 having the two array head groups layered over each other as a single array head group are able to be fabricated easily in terms of manufacture, and enable increase in the resolution. In addition, the example of the arrangement of the array heads 44 illustrated in FIG. 4E enables reduction of the amount of accumulated information in the memory of the system control device 18 more than the example of the arrangement of the plural array heads 44 illustrated in FIG. 4D.

Further, as illustrated in FIG. 2, the optical unit 43, which is an example of an optical system, has: a collimator lens 43*a* that converts a divergent light bundle of laser light emitted from the optical fibers 42 into a parallel light bundle; and a condenser lens 43*b* that condenses the laser light to a surface of the thermosensitive recording label RL, the surface being a surface to be irradiated with laser. Further, whether or not the optical unit 43 is to be provided may be selected appropriately, according to the purpose.

The image information output unit 47, such as a personal computer, inputs image information to the controller 46. The controller 46 generates, based on the input image information, a driving signal for driving each of the drivers 5. The controller 46 transmits the generated drive signal to each of the drivers 45. Specifically, the controller 46 includes a clock generator. When a clock number oscillated by the clock generator reaches a prescribed clock number, the controller 46 transmits the drive signal for driving each of the drivers 45, to each of the drivers 45.

When the drivers 45 receive the driving signal, the drivers 45 respectively drive the corresponding laser emitting elements 41. According to the driving by the drivers 45, the laser emitting elements 41 emit laser light. The laser light emitted from the laser emitting elements 41 enters the corresponding optical fibers 42, and is emitted from the laser emitting portions 42*a* of the optical fibers 42. After being transmitted through the collimator lens 43*a* and the condenser lens 43*b* of the optical unit 43, the laser light emitted from the laser emitting portions 42*a* of the optical fibers 42 is emitted onto the surface of the thermosensitive recording label RL of the container C serving as the recording target. Through heating by the laser light emitted onto the surface of the thermosensitive recording label RL, an image is recorded on the surface of the thermosensitive recording label RL.

If a device, which records images on recording targets by using a galvanometer mirror and deflecting laser light, is used as the recording device, an image of a character or the like is recorded by irradiation with the laser light in a single stroke by rotation of the galvanometer mirror. Thus, there is a problem that if a certain amount of information is recorded on a recording target, recording is not made in time unless conveyance of the recording target is stopped. On the contrary, in the recording device 14 according to this embodiment, by use of the laser array having the plural laser emitting elements 41 arranged in an array, an image is able to be recorded on a recording target by ON/OFF control of the laser emitting elements respectively corresponding to pixels. Thereby, even if the amount of information is large, without stoppage of the conveyance of the container C, an image is able to be recorded on the recording target. Therefore, the recording device 14 according to this embodiment enables recording of an image without reduction in the productivity, even if much information is recorded on a recording target.

As described later, the recording device 14 according to this embodiment records an image on a recording target by emitting laser light and heating the recording target, and thus laser emitting elements 41 having output that is high to a certain degree need to be used. Therefore, the amount of heat generated by the laser emitting elements 41 is large. In a conventional laser array recording device not having the fiber array unit 14*b*, laser emitting elements 41 need to be arranged in an array at intervals according to the resolution. Therefore, in the conventional laser array recording device, the laser emitting elements 41 need to be arranged at a very narrow pitch for the resolution to be 200 dpi. As a result, in the conventional laser array recording device, heat in the laser emitting elements 41 is difficult to escape, and the temperature of the laser emitting elements 41 becomes high. When the temperature of the laser emitting elements 41 becomes high in the conventional laser array recording device: wavelength and optical output of the laser emitting elements 41 fluctuate; the recording target is unable to be heated to a prescribed temperature; and a satisfactory image is unable to be obtained. Further, in the conventional laser array recording device, for prevention of such increase in the temperature of the laser emitting elements 41, the conveyance speed of the recording target needs to be decreased and the emission intervals of the laser emitting elements 41 need to be increased, and thus the productivity is unable to be increased sufficiently.

Normally, a chiller type cooling unit is often used as the cooling unit 50, and with this type, only cooling is performed without heating. Therefore, the temperature of the light source does not become higher than the set temperature of the chiller, but the temperature of the cooling unit 50 and the laser emitting elements 41 that are the laser light source brought into contact therewith fluctuates. When semiconductor lasers are used as the laser emitting elements 41, a phenomenon where the laser output changes according to the temperature of the laser emitting elements 41 occurs (the laser output becomes high when the temperature of the laser emitting elements 41 becomes low). Therefore, for control of the laser output, image formation is preferably executed properly by: measurement of the temperature of the laser emitting elements 41 or the temperature of the cooling unit 50; and control of an input signal to the drivers 45 for control of the laser output such that the laser output becomes constant, according to a result of the measurement.

As to this point, the recording device 14 according to the embodiment is a fiber array recording device using the fiber array unit 14*b*. By use of the fiber array recording device, the laser emitting portions 42*a* of the fiber array unit 14*b* just need to be arranged at a pitch according to the resolution, and there is no longer a need for a pitch of the laser emitting elements 41 of the laser array unit 14*a* to be made a pitch according to the image resolution. Thereby, the recording device 14 according to the embodiment enables pitches among the laser emitting elements 41 to be sufficiently wide so as to enable sufficient radiation of heat from the laser emitting elements 41. Accordingly, the recording device 14 according to the embodiment enables the increase in temperature of the laser emitting elements 41 to be lessened, and enables the fluctuation of wavelength and optical output of the laser emitting elements 41 to be lessened. As a result, the recording device 14 according to the embodiment enables a satisfactory image to be recorded on a recording target. Further, even if emission intervals of the laser emitting elements 41 are shortened, the increase in temperature of the laser emitting elements 41 is able to be lessened, the conveyance velocity of the container C is able to be increased, and thus the productivity is able to be increased.

Further, in the recording device 14 according to this embodiment, by the cooling unit 50 being provided and the laser emitting elements 41 being liquid-cooled, the increase in temperature of the laser emitting elements 41 is able to be lessened even more. As a result, the recording device 14 according to this embodiment enables the emission intervals of the laser emitting elements 41 to be shortened, the conveyance velocity of the container C to be increased, and thus the productivity to be increased, even more. In the recording device 14 according to this embodiment, the laser emitting elements 41 are liquid-cooled, but the laser emitting elements 41 may be air-cooled by use of a cooling fan or the like. The cooling efficiency of liquid-cooling is higher than that of air-cooling, and has an advantage that the laser emitting elements 41 are able to be cooled well. However, although the cooling efficiency of air-cooling is lower than that of liquid-cooling, air-cooling has an advantage that the laser emitting elements 41 are able to be cooled inexpensively.

Figure 5:
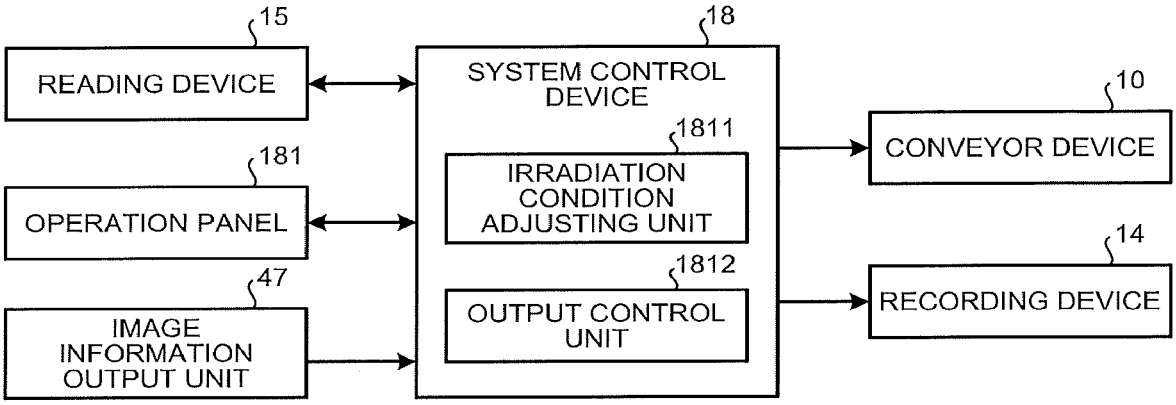
FIG. 5 is a block diagram illustrating a part of an electric circuit in the image recording system.

FIG. 5 is a block diagram illustrating a part of an electric circuit in the image recording system 100. In FIG. 5, the system control device 18: includes a CPU, a RAM, a ROM, a non-volatile memory, and the like; controls driving of various devices in the image recording system 100; and executes various kinds of arithmetic processing. The conveyor device 10, the recording device 14, the reading device 15, an operation panel 181, the image information output unit 47, and the like are connected to this system control device 18.

The operation panel 181 has a touch panel type display or various keys, displays an image on a display, and receives various kinds of information input through key operations by an operator.

As illustrated in FIG. 5, the system control device 18 functions as an irradiation condition adjusting unit 1811 and an output control unit 1812, by the CPU operating according to a program stored in the ROM or the non-volatile memory.

The irradiation condition adjusting unit 1811 adjusts a laser irradiation condition of laser light emitted from the laser emitting elements 41 of the recording device 14 for when image dots are recorded by the recording device 14. For example, the irradiation condition adjusting unit 1811 according to this embodiment causes laser light to be emitted by the recording device 14 such that a part of an image dot recorded on a recording target moving relatively to the recording device 14 overlaps an adjacent image dot, and makes a laser irradiation condition for when image dots forming a boundary between a colored portion and a non-colored portion are recorded, different from a laser irradiation condition for when the other image dots are recorded.

Further, the irradiation condition adjusting unit 1811 makes laser irradiation start timing for when image dots forming a boundary between a colored portion and a non-colored portion are recorded, the boundary being at an upstream side in the X-axis direction (relative movement direction) of the recording target, later than laser irradiation start timing for when the other image dots are recorded, and makes laser irradiation end timing for when image dots forming a boundary between the colored portion and the non-colored portion are recorded, the boundary being at a downstream side in the X-axis direction of the recording target, earlier than the laser irradiation end timing for when the other image dots are recorded. Further, the irradiation condition adjusting unit 1811 sets, based on an X-direction pitch of image dots and a radius of the image dots, laser irradiation timing by the recording device 14. Furthermore, the irradiation condition adjusting unit 1811 changes the laser irradiation timing when the power of laser light by the recording device 14 is changed.

Further, the irradiation condition adjusting unit 1811 makes power of laser light for when image dots forming a boundary between the colored portion and the non-colored portion in the Z-axis direction of the recording target (a direction intersecting (orthogonal to) the relative movement direction) are recorded, lower than power of laser light for when the other image dots are recorded. Furthermore, the irradiation condition adjusting unit 1811 records plural image dots continuously by continuous lighting of laser light by the recording device 14, if an image dot adjacent in the X-axis direction to an image dot forming a boundary between the colored portion and the non-colored portion in the Z-axis direction is present. The irradiation condition adjusting unit 1811 sets the power of laser light emitted from the recording device 14, according to the temperature of the laser emitting elements 41.

The output control unit 1812 controls output of the laser emitting elements 41 respectively corresponding to the laser emitting portions 42*a,* when an image is recorded on the recording target by the recording device 14. Based on the laser irradiation condition adjusted by the irradiation condition adjusting unit 1811, the output control unit 1812 according to this embodiment controls irradiation with laser light by the recording device 14.

Next, an example of operation of the image recording system 100 will be described by reference to FIG. 1. Firstly, the container C having luggage accommodated therein is placed on the conveyor device 10 by an operator. The operator places the container C on the conveyor device 10 such that a side surface of the body of the container C is positioned at the −Y side, that is, such that the side surface faces the recording device 14, the side surface having the thermosensitive recording label RL pasted thereon.

When the operator operates the operation panel 181 and starts the system control device 18, a conveyance start signal is transmitted from the operation panel 181 to the system control device 18. The system control device 18 that has received the conveyance start signal starts driving the conveyor device 10. The container C placed on the conveyor device 10 is then conveyed toward the recording device 14 by the conveyor device 10. An example of the conveyance speed of the container C is 2 m/sec.

Upstream of the recording device 14 in the conveyance direction of the container C, a sensor that detects the container C conveyed on the conveyor device 10 is arranged. When this sensor detects the container C, a detection signal is transmitted from the sensor to the system control device 18. The system control device 18 has a timer. As the system control device 18 receives the detection signal from the sensor, the system control device 18 starts time measurement by use of the timer. Based on the elapsed time from the time of the reception of the detection signal, the system control device 18 then perceives when the container C will reach the recording device 14.

As the elapsed time from the time of the reception of the detection signal becomes T1 and the container C reaches the recording device 14, the system control device 18 outputs a recording start signal to the recording device 14 such that an image is recorded on the thermosensitive recording label RL pasted on the container C that passes the recording device 14.

Based on image information received from the image information output unit 47, the recording device 14 that has received the recording start signal emits laser light of a predetermined power toward the thermosensitive recording label RL on the container C moving relatively to the recording device 14. Thereby, an image is recorded on the thermosensitive recording label RL contactlessly.

Examples of the image recorded on the thermosensitive recording label RL (the image information transmitted from the image information output unit 47) include: contents of the luggage accommodated in the container C, an image of characters, such as information on the transport destination; and a code image, such as a bar code or a two-dimensional code (QR code or the like) having information that has been coded, the information being the contents of the luggage accommodated in the container, the information on the transport destination, and the like.

The container C, on which the image has been recorded in the process of passing through the recording device 14, passes the reading device 15. When the container C passes the reading device 15, the reading device 15 reads the code image, such as the bar code or two-dimensional code recorded on the thermosensitive recording label RL, and obtains information, such as the contents of the luggage accommodated in the container C and the information on the transport destination. The system control device 18 collates the information obtained from the code image with the image information transmitted from the image information output unit 47, and checks whether or not the image has been correctly recorded. If the image has been correctly recorded, the system control device 18 sends the container C to a subsequent process (for example, a transport preparation process) via the conveyor device 10.

On the contrary, if the image has not been correctly recorded, the system control device 18 temporarily stops the conveyor device 10, and displays, on the operation panel 181, that the image has not been correctly recorded. Further, if the image has not been correctly recorded, the system control device 18 may convey that container C to a prescribed conveyance destination.

In this embodiment, an image of a predetermined resolution is recorded on a recording target with prescribed pitches being: an X-axis direction (the sub-scanning direction: the relative movement direction of the recording target) pitch P1 of image dots G recorded on the recording target; and a Z-axis direction (the main scanning direction: the direction intersecting (orthogonal to) the relative movement direction of the recording target) pitch P2. The X-axis direction image dot pitch P1 is set at a prescribed pitch by adjustment of the irradiation timing of the laser light. The Z-axis direction image dot pitch P2 is set at a prescribed pitch according to the structure of the recording device 14, such as the arrangement pitch of the laser emitting portions of the optical fibers 42 or the configuration of the optical unit 43.

Figure 6:
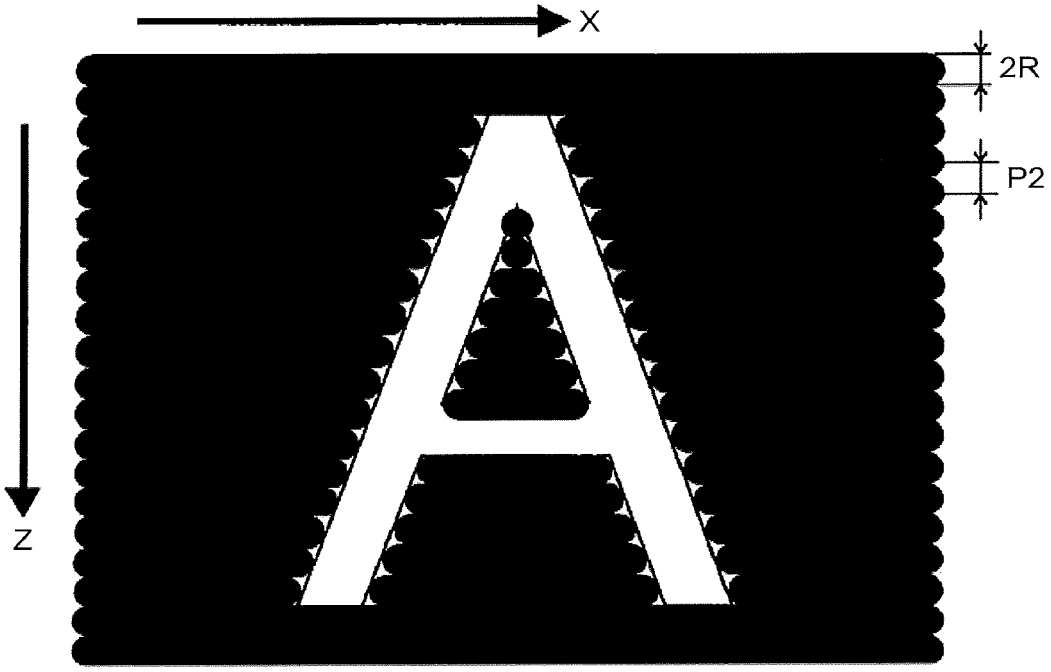
FIG. 6 is a diagram illustrating an example where an outlined image has been recorded with Z-axis direction widths of image dots being made the same as their Z-axis direction image dot pitch.

FIG. 6 is a diagram illustrating an example where an outlined image has been recorded with a Z-axis direction width 2R of an image dot being made the same as the Z-axis direction image dot pitch P2. As illustrated in FIG. 6, when the Z-axis direction width 2R of an image dot is made the same as the Z-axis direction image dot pitch P2 such that image dots adjacent to each other in the Z-axis direction do not overlap each other, the boundary edge between the black colored portion and the white non-colored portion becomes jagged and thus the image becomes poor in appearance. In FIG. 6, the white non-colored portion is the outlined image.

Therefore, in this embodiment, for an edge of an image recorded on a recording target to be smoothed, a part of an image dot is made to overlap an image dot adjacent thereto. By the overlap of the part of the image dot with the adjacent image dot, jaggedness of a boundary edge between a colored portion formed of a series of image dots and a non-colored portion is lessened. Thereby, the boundary edge between the colored portion and the non-colored portion is able to be smoothed.

In the X-axis direction, by adjustment of irradiation time of laser such that an X-axis direction length F (see FIG. 8) of an image dot in the X-axis direction is made longer than the X-axis direction image dot pitch P1, a part of the image dot is made to overlap an image dot adjacent thereto. Since the Z-axis direction image dot pitch P2 is determined beforehand by the structure of the recording device 14, a part of an image dot is difficult to be made to overlap an image dot adjacent thereto by narrowing of the Z-axis direction image dot pitch P2. Accordingly, in this embodiment, the Z-axis direction width 2R of an image dot recorded on a recording target is made larger than the Z-axis direction image dot pitch P2 by irradiation with laser light that has been increased in laser power, and a part of the image dot is thus made to overlap an image dot adjacent thereto in the Z-axis direction.

Figure 7:
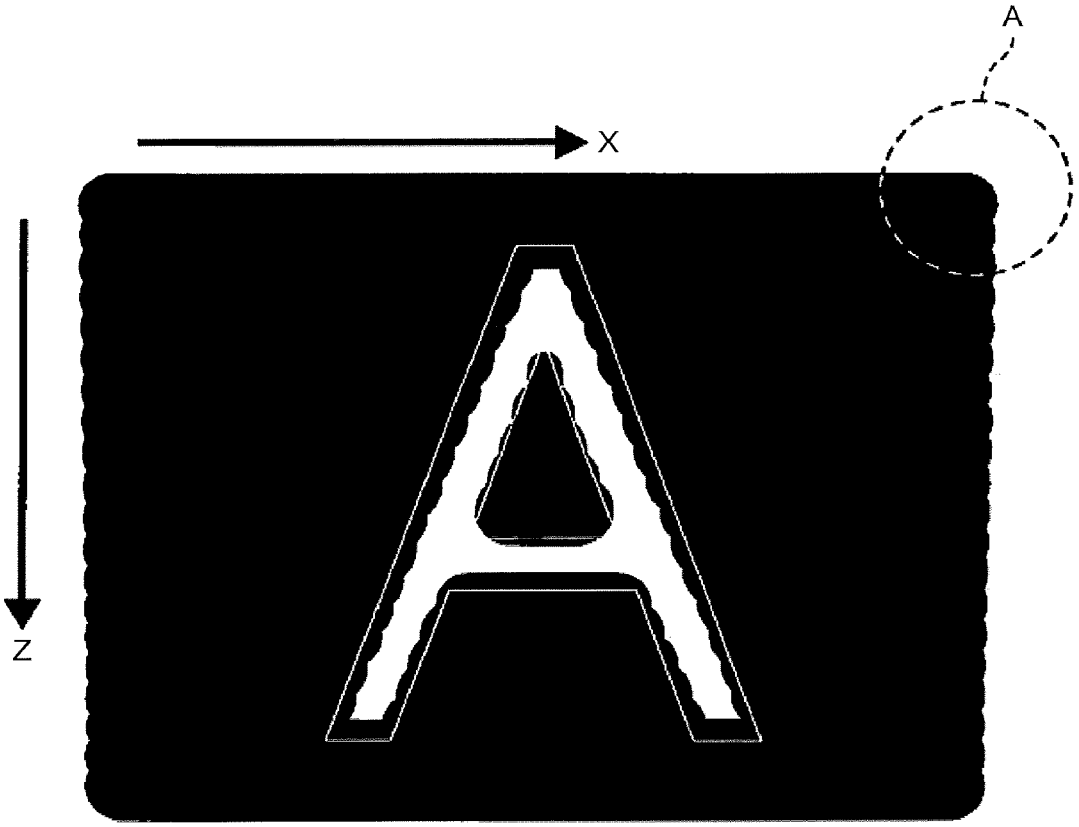
FIG. 7 is a diagram illustrating an example where an outlined image has been recorded with Z-axis direction widths of image dots G being made larger than their Z-axis direction image dot pitch.
Figure 8:
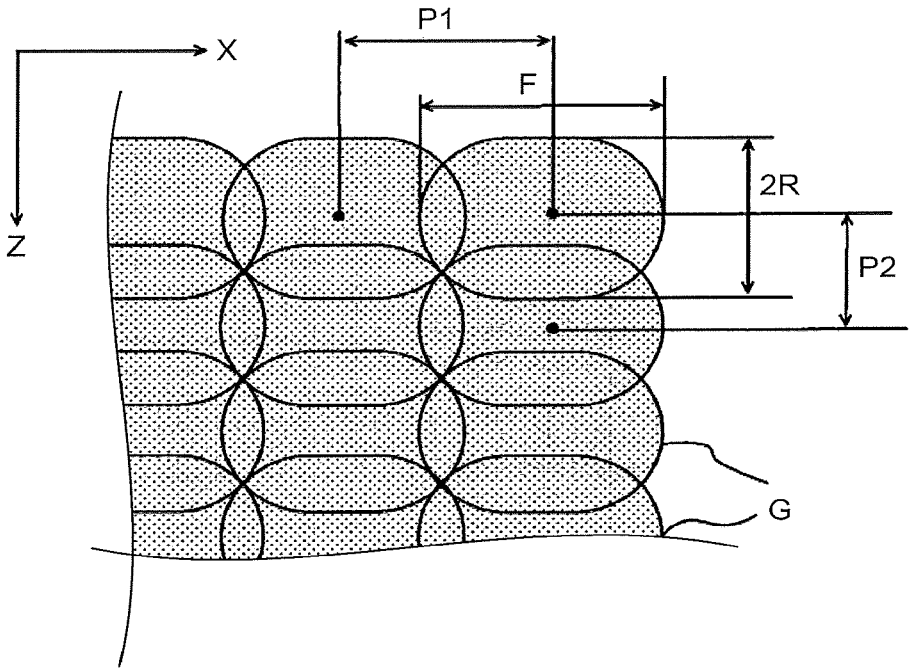
FIG. 8 is an enlarged view of an A-portion in FIG. 7.

FIG. 7 is a diagram illustrating an example where an outlined image has been recorded with the Z-axis direction width 2R of each image dot being made larger than the Z-axis direction image dot pitch P2. FIG. 8 is an enlarged view of an A-portion in FIG. 7. As illustrated in FIG. 7 and FIG. 8, by the Z-axis direction width 2R of each image dot G being made larger than the Z-axis direction image dot pitch P2 through the increase in the laser power, adjacent image dots G overlap each other in the Z-axis direction. Thereby, the boundary edge between the colored portion and the non-colored portion is able to be smoothed in the Z-axis direction, as compared to the prior case illustrated in FIG. 6.

Further, by the X-axis direction length F of each image dot G being made longer than the X-axis direction image dot pitch P1 through the increase in the laser irradiation time, adjacent image dots G overlap each other in the X-axis direction also. Thereby, the boundary edge between the colored portion and the non-colored portion is able to be smoothed in the X-axis direction, as compared to the prior case illustrated in FIG. 6.

Next, an example of a specific method for the adjustment of the X-axis direction length of each image dot G will be proposed, but the specific method is not limited to the following method. Image information received from the image information output unit 47 is transferred as a bitmapped image to the recording device 14 from the system control device 18 in FIG. 5. The bitmapped image has pixel information that is gradation data of each pixel. Normally, gradation data are used in recording a grayscale image, but since gradation data are information representing black/white inversion, recording a grayscale image is unnecessary, and gradation data may be used as parameters for adjustment of the X-axis direction length of each image dot G.

In this embodiment, by control of laser irradiation timing for an image according to gradation values of the image, adjustment of the X-axis direction length of each image dot G is realized. Further, in this embodiment, by change of gradation data of a bitmapped image, adjustment of the X-axis direction length of each image dot G is realized. In addition, dealing with the conveyance velocity, the environmental temperature, and the differences among recording targets, which requires energy adjustment, is realized by peak power control of laser light. In this embodiment, image recording is implemented by the system control device 18 adjusting the gradation of a bitmapped image and transferring the adjusted bitmap data to the recording device 14.

Data transmission from the image information output unit 47 (see FIG. 5) to the system control device 18 may be executed by transmission of bitmap data that have been added with header information. The system control device 18 may determine the contents to be processed from information indicated by the header information accompanying the received bitmap data, the information being, herein, black/white inversion information indicating that the image is to be recorded by black/white inversion. Similarly, when the X-axis direction length of each image dot G is to be adjusted by the recording device 14, transmission may be executed by addition of header information including black/white inversion information upon data transmission from the system control device 18 to the recording device 14.

The Z-axis direction width 2R of each image dot G is preferably set at 1.1 times to 1.5 times the pitch P2 ($1.1P2 \leq 2R \leq 1.5P2$). If the Z-axis direction width 2R of each image dot G is less than 1.1 times the pitch P2, the image edge smoothing effect becomes insufficient. On the contrary, by increase in the laser power of the laser light, or increase in the irradiation time of the laser light by decrease in the conveyance velocity or the like, the Z-axis direction width 2R of the image dot is able to increased. However, if the laser power of the laser light is increased too much, the recording target may be heated more than necessary, and this may result in decrease of the image density or burning of the recording target. Further, the amount of heat generated by the laser emitting elements 41 is increased and cooling may not be made in time, and thus the laser emitting elements 41 may become high in temperature. Further, the decrease in the conveyance velocity or the like influences the productivity. Therefore, the irradiation condition adjusting unit 1811 sets the laser irradiation timing, such that the Z-axis direction width 2R of each image dot G becomes equal to or less than 1.5 times the pitch P2. Thereby, a boundary edge between a colored portion and a non-colored portion is able to be smoothed with reduced damage of the recording target by laser light and reduced increase in temperature of the laser emitting elements 41. Further, without decrease of the productivity, a boundary edge between a colored portion and a non-colored portion is able to be smoothed.

However, by the Z direction width 2R of each image dot G being made larger than the image dot pitch P2 such that a part of the image dot G overlaps an adjacent image dot G, as illustrated in FIG. 7, a problem where a part of an image dot G overlaps the non-colored portion that is supposed to be white and the outlined image is crushed occurs.

Therefore, in this embodiment, the laser irradiation condition is adjusted by the irradiation condition adjusting unit 1811, such that a part of each image dot G does not overlap the non-colored portion. Specifically, for the overlap of the image dot G with the non-colored portion in the conveyance direction (X-axis direction) of the container C, the irradiation condition adjusting unit 1811 prevents the overlap by making the laser irradiation timing different from the normal irradiation timing. As to the overlap in the Z-axis direction that is the arrangement direction of the optical fibers 42, the irradiation condition adjusting unit 1811 prevents the overlap by decreasing the laser power.

Firstly, the prevention of the X-axis direction (sub-scanning direction) overlap of the image dot G with the non-colored portion will be described.

Figure 9:
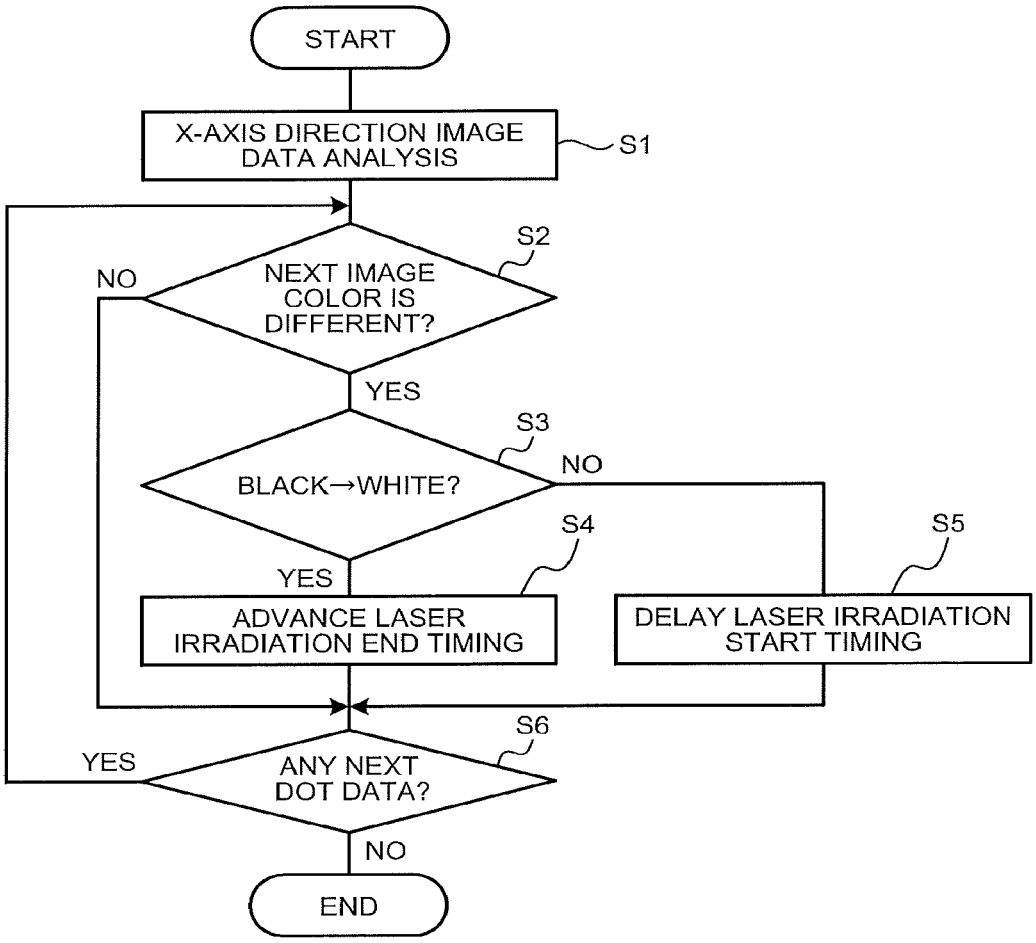
FIG. 9 is a control flow diagram for adjustment of laser irradiation timing.
Figure 10A:
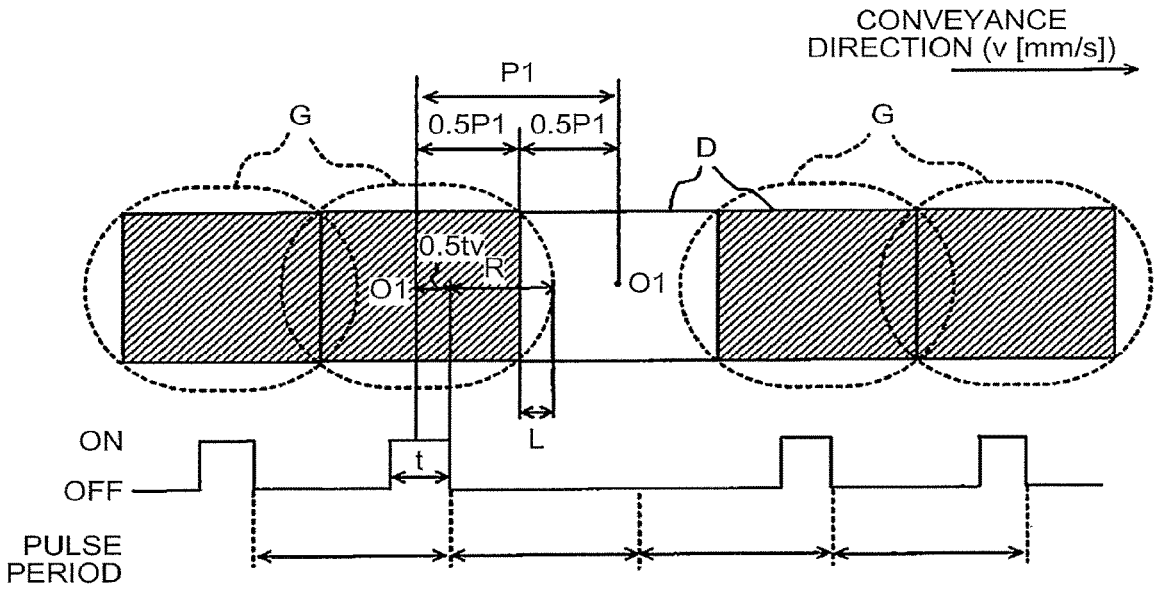
FIG. 10A is a timing chart for ON/OFF of conventional laser irradiation.
Figure 10B:
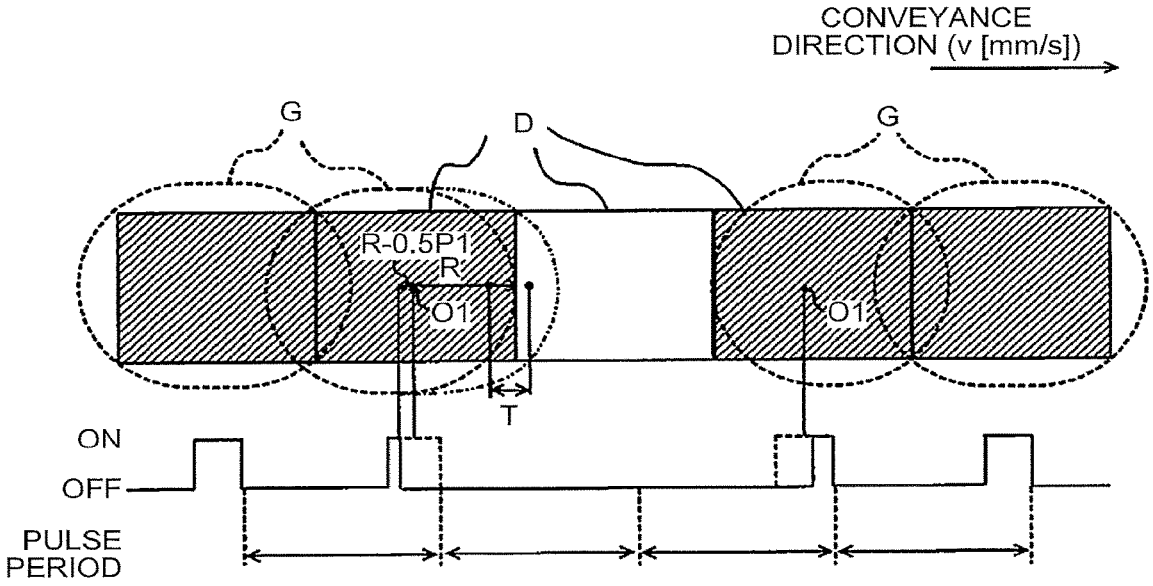
FIG. 10B is a timing chart for ON/OFF of laser irradiation according to the embodiment.

FIG. 9 is a control flow diagram for adjustment of laser irradiation timing, and FIG. 10 is a timing chart for ON/OFF of laser irradiation. FIG. 10A illustrates ON/OFF timing of conventional laser irradiation, and FIG. 10B illustrates an ON/OFF timing chart for laser irradiation according to this embodiment.

As illustrated in FIG. 9, the irradiation condition adjusting unit 1811 executes image data analysis in the X-axis direction when the irradiation condition adjusting unit 1811 receives image data from the image information output unit 47 (S1). Specifically, the irradiation condition adjusting unit 1811 perceives whether a dot D of image data to be recorded first is a black dot ("1" in binarization) or a white dot ("0" in binarization), the dot D being the most downstream in the conveyance direction (+X direction). Subsequently, the irradiation condition adjusting unit 1811 checks whether or not a dot to be recorded next has different color to the dot D, the dot to be recorded next being adjacent to and upstream of the dot D in the conveyance direction (S2). If the colors of the dots change from that of a black dot to that of a white dot (Yes at S2 and Yes at S3), the irradiation condition adjusting unit 1811 makes laser irradiation end timing for this black dot earlier than the normal end timing (S4).

As illustrated in FIG. 10, in this embodiment, since an image dot G is formed by irradiation of a recording target with laser light for a predetermined time period t while the recording target is being conveyed, as illustrated with a dotted line in the figure, the image dot G has an approximately elliptical shape elongated in the conveyance direction.

In a case where dots D of image data change from a black dot to a white dot (when laser irradiation is ON now and laser irradiation will be OFF the next time), if the laser irradiation end timing is not made earlier, the following happens. That is, as illustrated in FIG. 10A, a part of an image dot forming a boundary between a colored portion and a non-colored portion (the second image dot from the right in the figure) overlaps the non-colored portion upstream thereof and adjacent thereto in the relative movement direction and crushes the non-colored portion, the boundary being at an upstream side in the recording target movement direction.

On the contrary, in this embodiment, when dots D of image data change from a black dot to a white dot, the laser irradiation end timing is made earlier than the normal timing. Thereby, as illustrated in FIG. 10B, the second image dot G on the right in the figure is prevented from overlapping the non-colored portion upstream thereof and adjacent thereto in the relative movement direction. Thereby, the non-colored portion is prevented from being crushed.

On the contrary, if, as illustrated in FIG. 9, dots D of image data change from a white dot to a black dot (Yes at S2 and No at S3), the irradiation condition adjusting unit 1811 makes the laser irradiation timing later than the normal timing when that next black dot is recorded (S5).

In the case where dots D of image data change from a white dot to a black dot (when laser irradiation is OFF now and laser irradiation will be ON the next time), if the laser irradiation start timing is not delayed, the following happens. That is, as illustrated in FIG. 10A, a part of an image dot forming a boundary between a colored portion and a non-colored portion (the fourth image dot from the right in the figure) overlaps the non-colored portion downstream therefrom and adjacent thereto in the relative movement direction and crushes the non-colored portion, the part being at a downstream side in the recording target movement direction.

On the contrary, when dots D of image data change from a white dot to a black dot, the irradiation condition adjusting unit 1811 according to this embodiment makes the laser irradiation start timing later than the normal timing. Thereby, as illustrated in FIG. 10B, the fourth image dot G from the right in the figure is prevented from overlapping the non-colored portion downstream therefrom and adjacent thereto in the relative movement direction. Thereby, the non-colored portion is prevented from being crushed.

The irradiation condition adjusting unit 1811 then ends the flow, as illustrated in prior FIG. 9, when the above processing has been executed for a dot that is the most upstream in the conveyance direction (No at S6).

As illustrated in FIG. 10A, an amount L of overlap of an image dot G may be found as follows. The image dots G each have an approximately elliptical shape elongated in the X-axis direction (sub-scanning direction). More specifically, the shape is a so-called koban (old Japanese oval coin) shape having semicircular portions connected at both sides of a rectangular portion in the X-axis direction. The radius of the semicircular portions is R, and when the laser irradiation time is t and the conveyance velocity of the recording target is v, the X-axis direction length of the rectangular portion is tv [mm]. Therefore, since the X-axis direction image dot pitch is P1, the overlap amount L is given by the following equation.

$$L=0.5tv+R-0.5P1$$

Therefore, by advancing the irradiation end timing or delaying the irradiation start timing by the overlap amount L calculated by the above equation, an image dot G is able to be prevented from overlapping the non-colored portion. That is, the irradiation end timing is advanced, or the irradiation start timing is delayed, by (L/v) hours. As described above, in this embodiment, the irradiation condition adjusting unit 1811 sets the irradiation timing of laser light by the recording device 14, based on the X-axis direction (image dot movement direction) pitch and the radius of the image dots.

Figure 11:
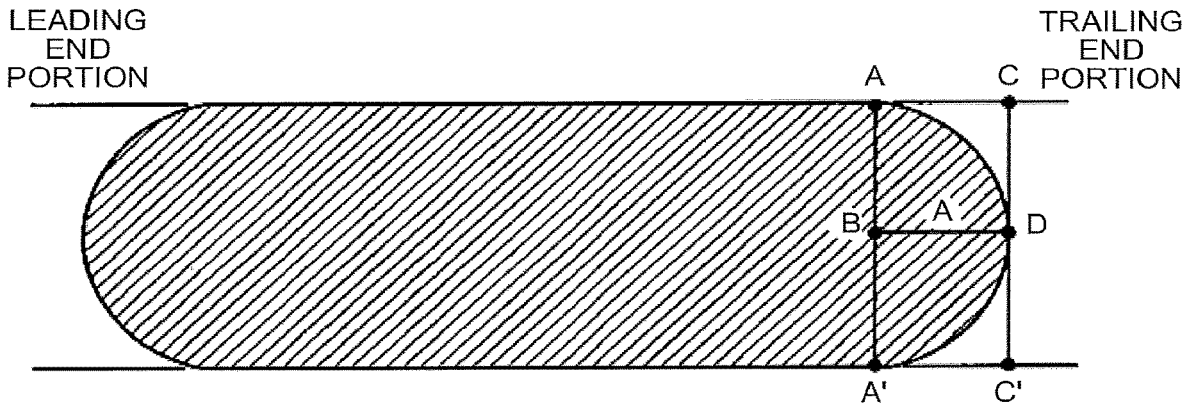
FIG. 11 is a diagram for explanation of measurement of a radius R of an image dot.

The radius R of the circular portion of the image dot G and the image dot pitch P2 are values that have been experimentally found beforehand. FIG. 11 is a diagram for explanation of how the radius R of the circular portion of the image dot G is found. Firstly, a line having a Z-axis direction (main scanning direction) width of one dot is recorded on a recording target. Subsequently, an image density is measured by a microdensitometer (having a slit width of 5 μm), and an outline of a portion having the average density of the maximum density value and the minimum density value is taken out and enlarged to 500 times its size. Subsequently found are intersection points A and A' between: a circular arc at one X-axis direction (sub-scanning direction) end of the line; and one Z-axis direction (main scanning direction) end and the other Z-axis direction end. Subsequently, the middle point B of the line segment A-A' is found. Subsequently, a line segment C-C' parallel to the line segment A-A' and in contact with the circular arc is found, and a contact point D between the line segment C-C' and the circular arc is found. A length from the found middle point B to the found contact point D is then found, and the radius R of the circular portion of the image dot G is thus found.

Figure 12:
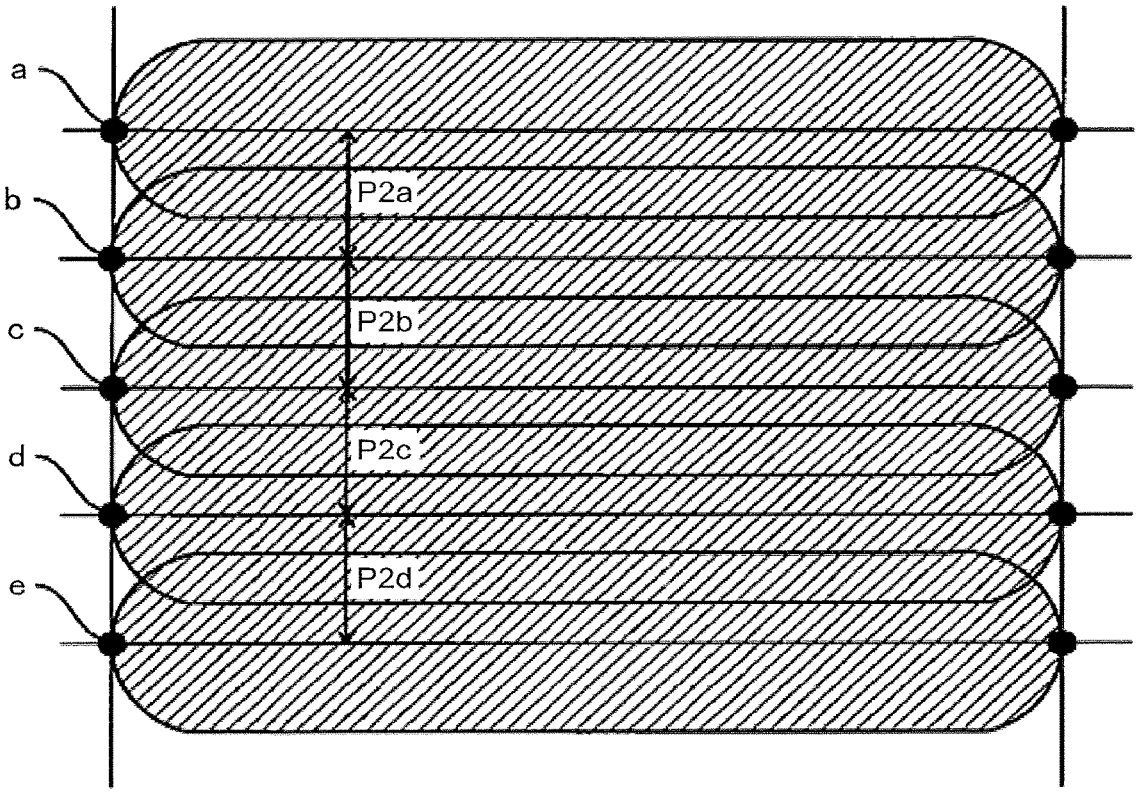
FIG. 12 is a diagram for explanation of measurement of a Z-axis direction image dot pitch.

FIG. 12 is a diagram for explanation of how the Z-axis direction (main scanning direction) image dot pitch P2 is found. Firstly, as illustrated in FIG. 12, lines of five dots in the main scanning direction are recorded on a recording target. Subsequently, an image density is measured by a microdensitometry meter (having a slit width of 5 μm), and an outline of a portion having the average density of the maximum density value and the minimum density value is taken out and enlarged to 500 times its size. Subsequently, vertices a to e of these lines are found, and straight lines passing these vertices of the lines are drawn. Subsequently, distances between the vertices of the lines (the line segment a-b, line segment b-c, line segment c-d, and line segment d-e) are respectively found, and Z-axis direction (main scanning direction) image dot pitches P2*a*, P2*b*, P2*c*, and P2*d* are thus found. From the found P2*a* to P2*d*, an average value of these image dot pitches is found, and that average value is determined as the Z-axis direction (main scanning direction) image dot pitch P2.

The X-axis direction (sub-scanning direction) image dot pitch P1 may be found by multiplication of the laser irradiation period (pulse period) by the conveyance velocity v.

Further, as described later, an X-axis direction leading end of an image dot G is preferably in a range of T illustrated in FIG. 10B. A laser irradiation timing shift amount W for the X-axis direction leading end of the image dot G to be in this range T satisfies a relation, $0.5tv+0.5(R-0.5P1)\leq W\leq 0.5tv+1.5(R-0.5P1)$. Therefore, the irradiation condition adjusting unit 1811 sets the laser irradiation timing such that this relation for the laser irradiation timing shift amount W is satisfied.

Further, in this embodiment, the laser power is able to be changed by a user. Specifically, if a user sees an image recorded on a recording target and feels that the image is not dense enough, the user increases the laser power by operating the operation panel 181. Further, if the user feels that the image is too dense, the user decreases the laser power by operating the operation panel 181. By such change of the laser power, the size of an image dot G is changed, and the radius R of the circular portion of the image dot G is thus changed. Therefore, if the laser power is changed, the overlap amount $L=0.5tv+R-0.5P1$ is changed. In this embodiment, since the laser irradiation timing is shifted based on the overlap amount L calculated based on the radius R, when the laser power (power of laser light) is changed, the irradiation condition adjusting unit 1811 needs to change the laser irradiation timing, that is, to recalculate the amount of shift of the irradiation timing.

Specifically, a relation between the laser power and the radius R of the circular portion of an image dot is found beforehand by experiment or the like, and a relational expression or a table thereof is stored in a non-volatile memory. When the user changes the laser power by operating the operation panel 181, the irradiation condition adjusting unit 1811 finds, based on the laser power that has been changed and the relational expression or table stored in the memory, the radius R corresponding to this laser power. Based on the radius R found, the irradiation condition adjusting unit 1811 calculates the irradiation timing shift amount, and stores the calculated shift amount in the non-volatile memory. Thereby, even after the change of the laser power, the image dots G are prevented from overlapping the non-colored portion. Further, the image dots G are prevented from being recessed from the actual boundary between the non-colored portion and the colored portion; and thus an outlined image recorded on a recording target is prevented from becoming larger than that of the image data and the colored portion is prevented from becoming smaller than that of the image data.

Further, since the color developing temperature or the like differs depending on recording targets (thermosensitive recording portions); when a recording target is changed, the relation between the laser power and the radius R of the circular portion of the image dot may be changed. Therefore, plural data sets are stored in a memory respectively for types of recording targets (thermosensitive recording portions), each of the data sets being a relational expression or a table indicating a relation between the laser power and the radius R. If a recording target for recording of an image is to be changed, a user inputs type information of a recording target for recording of an image, by operating the operation panel. Based on the input information on the recording target input, the irradiation condition adjusting unit 1811 specifies the relational expression or table indicating the relation between the laser power and the radius R, the relational expression or table corresponding to the input recording target. Based on the specified relational expression indicating the relation between the laser power and the radius R, the irradiation condition adjusting unit 1811 increases the laser power such that the prescribed radius is achieved. Thereby, the boundary edge between the colored portion and the non-colored portion is able to be smoothed even if the recording target is changed.

Figure 13:
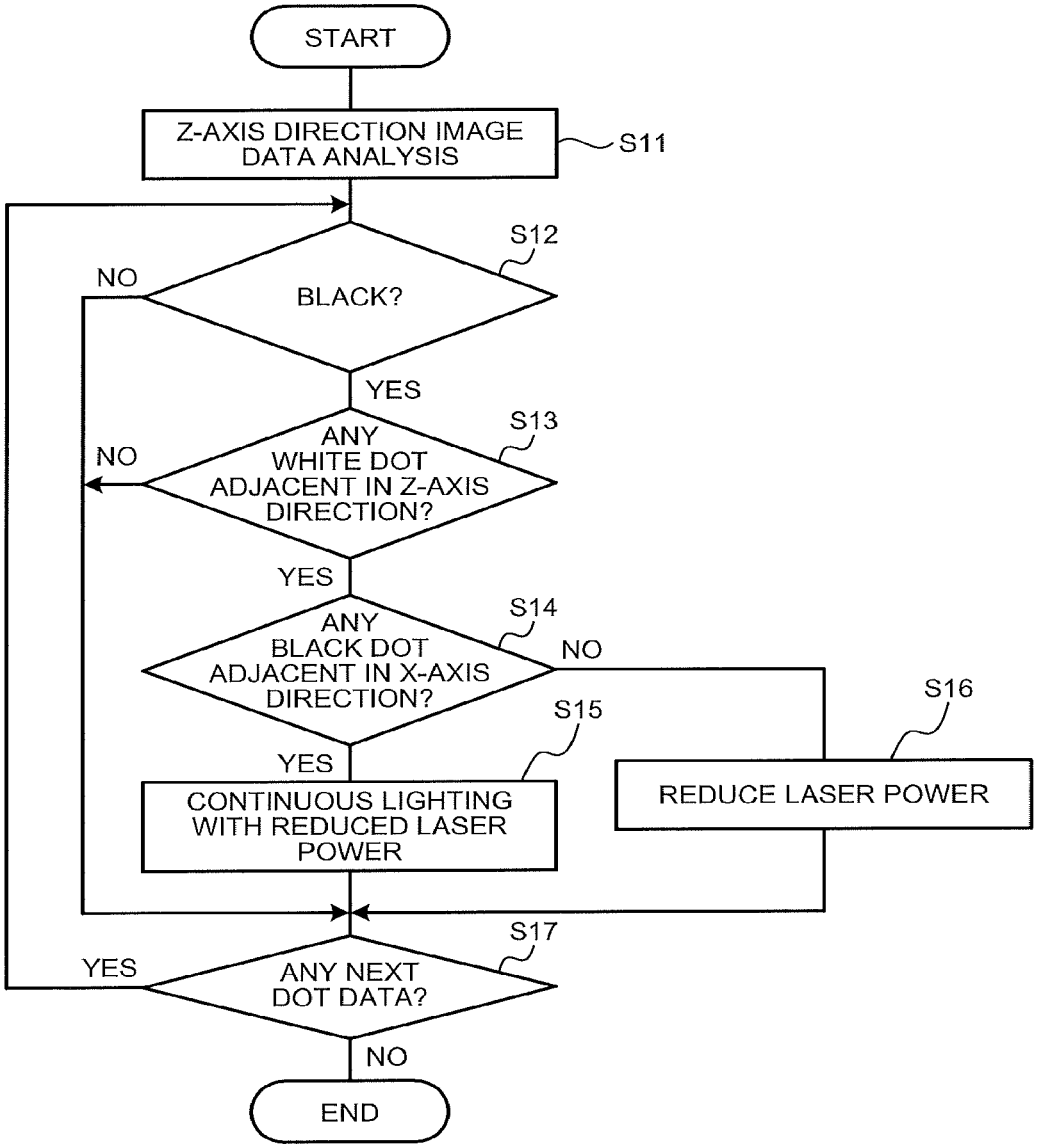
FIG. 13 is a control flow diagram for prevention of Z-axis direction overlap of image dots with a non-colored portion.

Next, the prevention of the Z-axis direction (main scanning direction) overlap of an image dot G with a non-colored portion will be described. FIG. 13 is a control flow diagram for the prevention of the Z-axis direction overlap of an image dot G with a non-colored portion. When the irradiation condition adjusting unit 1811 receives image data from the image information output unit 47, the irradiation condition adjusting unit 1811 executes image data analysis in the Z-axis direction also (S11). Specifically, the irradiation condition adjusting unit 1811 firstly perceives whether a dot of image data at one Z-axis direction end is a black dot ("1" in binarization) or a white dot ("0" in binarization) (S12). If the dot is a black dot, the irradiation condition adjusting unit 1811 checks dot data adjacent thereto in the Z-axis direction, and checks whether or not the dot data have a white dot (S13). If the dots adjacent in the Z-axis direction do not have a white dot (No at S13), the irradiation condition adjusting unit 1811 sets the laser power for image recording at this dot to a normal laser power.

If image recording is executed at the normal laser power when the dots adjacent in the Z-axis direction have a white dot (YES at S13), a part of the image dot overlaps the non-colored portion adjacent thereto in the Z-axis direction. Therefore, if the dots adjacent in the Z-axis direction have a white dot (YES at S13), the irradiation condition adjusting unit 1811 refers to dot data adjacent thereto in the X-axis direction to check whether or not the dot data have a black dot (S14).

If the dots adjacent in the X-axis direction have a black dot (Yes at S14), the irradiation condition adjusting unit 1811 executes setting such that image recording corresponding to the adjacent black dot and this dot is performed with reduced laser power and by continuous lighting (S15). By the reduction of laser power, temperature increase of the recording target due to the laser irradiation is lessened, and the image dot G is decreased in size. As a result, the image dot G is prevented from overlapping the non-colored portion. Nevertheless, since the image dot G is decreased in size when the laser power is reduced, the boundary edge in the Z-axis direction between the non-colored portion and the colored portion becomes jagged. However, by execution of the image recording corresponding to the adjacent black dot and this dot through the continuous irradiation with laser as described above, the boundary edge in the Z-axis direction between the non-colored portion and the colored portion becomes linear and the boundary edge in the Z-axis direction is able to be smoothed.

On the contrary, if the dots adjacent in the X-axis direction do not have a black dot (No at S14), the irradiation condition adjusting unit 1811 sets the laser power for image recording at this dot to a laser power less than the normal laser power. That is, the irradiation condition adjusting unit 1811 makes the power of laser light for when the image dots forming a boundary between the black colored portion and the white non-colored portion in the Z-axis direction are recorded, lower than the laser power for when the other image dots are recorded. As described above, by the reduction of the laser power, the image dots G are decreased in size, and the image dots G are prevented from overlapping the non-colored portion.

When the above processing has been executed for a dot at the other Z-axis direction end (No at S17), the flow is ended.

Figure 14:
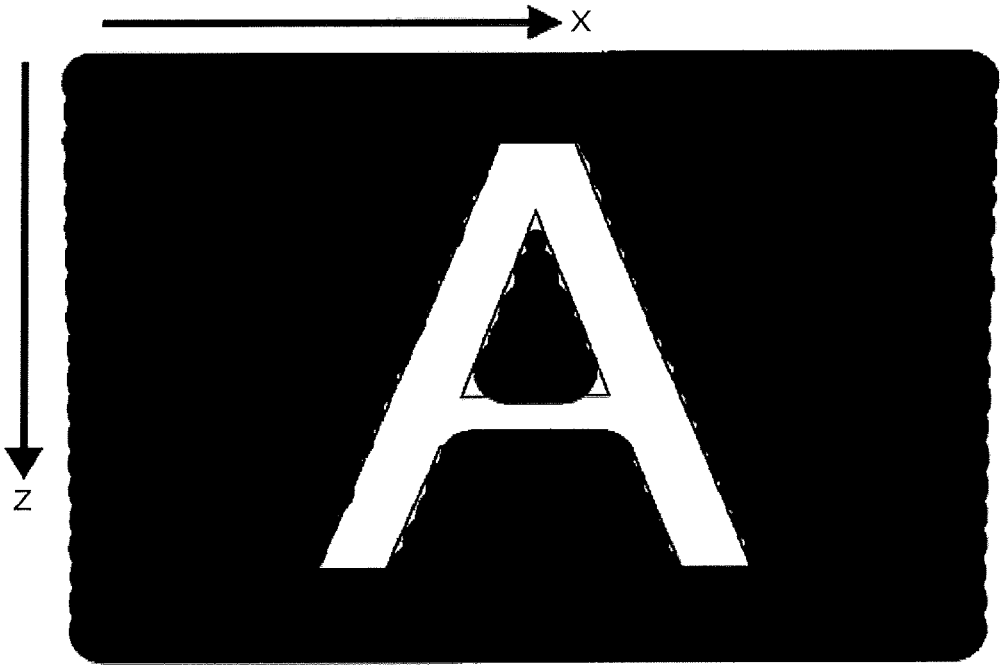
FIG. 14 is a diagram illustrating an example where an outlined image has been recorded by the device according to the embodiment.

FIG. 14 is a diagram illustrating an example where an outlined image has been recorded by the device according to the embodiment. As illustrated in FIG. 14, in this embodiment, by the above control of irradiation timing as illustrated in FIG. 9 and FIG. 10 for the X-axis direction, and the above control of laser power illustrated in FIG. 13 for the Z-axis direction, the boundary edge between the colored portion and the non-colored portion is able to be smoothed and thus crushing of the outlined image is able to be prevented.

Further, by the above described control, for a character image or the like also, image thickening where the actually recorded image becomes thicker than that of the image data is able to be prevented, crushing of the character is able to be prevented, and thus a satisfactory image is able to be obtained.

Next, verification experiments carried out by the applicant will be described.

FIRST EXAMPLE

Images as illustrated in FIG. 15 were recorded on recording targets by adjustment of laser power and laser irradiation timing, such that the X-axis direction (sub-scanning direction) image dot pitch P1 became 127 μm and the radius R of the image dots became 73 μm. The images illustrated in FIG. 15 are each an outlined image where its X-axis direction width is on a line having the X-axis direction image dot pitch P1 and extending in the Z-axis direction.

Figure 15A:
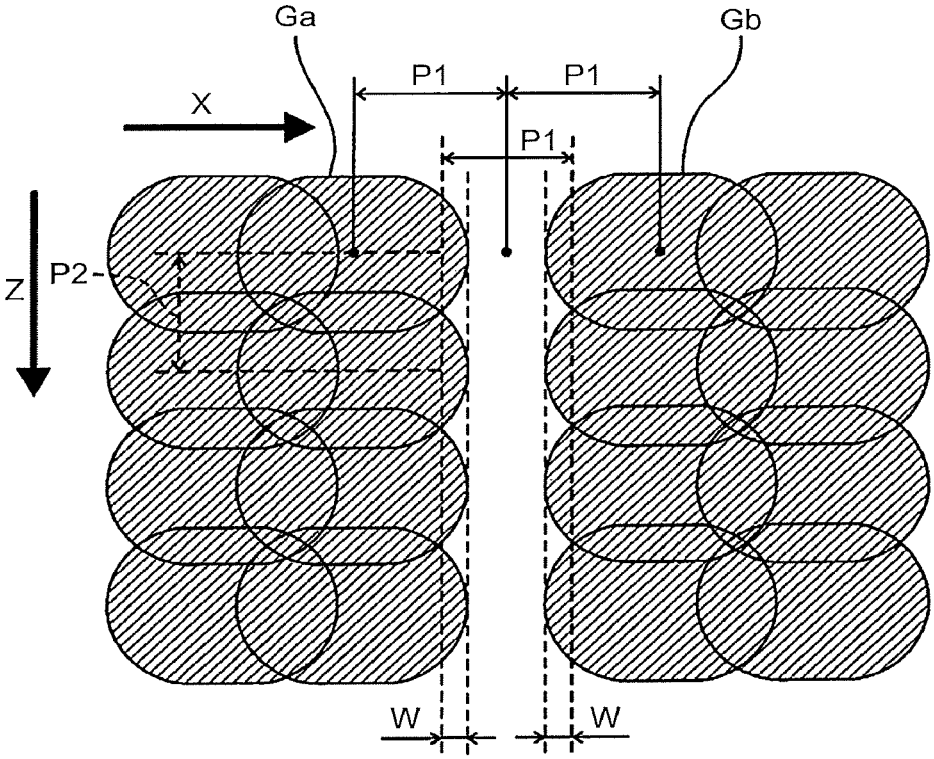
FIG. 15A is an enlarged view of an image recorded on a recording target in a verification experiment.
Figure 15B:
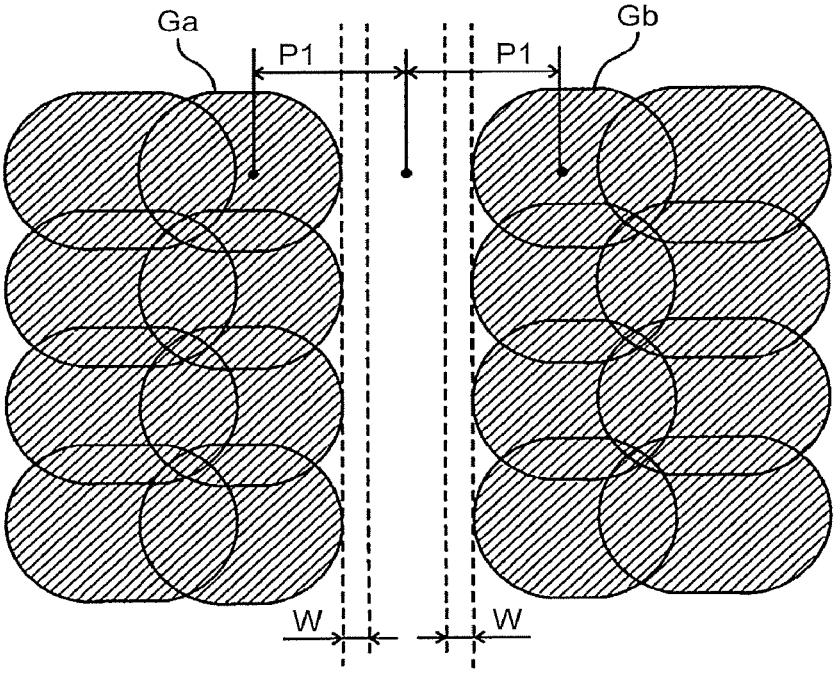
FIG. 15B is an enlarged view of an image recorded on a recording target in a verification experiment.

FIG. 15A illustrates a case where image dots Ga and Gb adjacent to a non-colored portion in the conveyance direction (X-axis direction) were formed at normal timing. In this first example, the laser irradiation timing was adjusted such that the X-axis direction widths of the image dots Ga and Gb adjacent to the non-colored portion in the conveyance direction (X-axis direction) became 10 μm (=R−0.5P1) shorter than those formed at the normal timing illustrated in FIG. 15A. Specifically, the image dot Ga adjacent to and upstream of the non-colored portion in the conveyance direction of the recording target was made 10 μm shorter by advancement of the timing for stoppage of laser irradiation from the normal timing. In contrast, the image dot Gb adjacent to and downstream from the non-colored portion in the conveyance direction of the recording target was made 10 μm shorter by delay of the timing for start of the laser irradiation (see FIG. 15B, where W represents a length, by which the image dots Ga and Gb adjacent to the non-colored portion in the conveyance direction (X-axis direction) illustrated in FIG. 15A were each made shorter than that in a case where the image dots were formed at the normal timing).

SECOND EXAMPLE

Except for adjustment of the laser irradiation timing such that the X-axis direction widths of the image dots Ga and Gb adjacent to the non-colored portion in the conveyance direction (X-axis direction) each became 15 μm (=1.5(R−0.5P1) shorter, this example was implemented in the same way as the first example.

THIRD EXAMPLE

Except for adjustment of the laser irradiation timing such that the X-axis direction widths of the image dots Ga and Gb adjacent to the non-colored portion in the conveyance direction (X-axis direction) each became 5 μm (=0.5(R−0.5P1) shorter, this example was implemented in the same way as the first example.

FIRST COMPARATIVE EXAMPLE

Except for adjustment of the laser irradiation timing such that the X-axis direction widths of the image dots Ga and Gb adjacent to the non-colored portion in the conveyance direction (X-axis direction) each became 20 μm (=2(R−0.5P1) shorter, this comparative example was implemented in the same way as the first example.

SECOND COMPARATIVE EXAMPLE

Except for adjustment of the laser irradiation timing such that the X-axis direction widths of the image dots Ga and Gb adjacent to the non-colored portion in the conveyance direction (X-axis direction) each became 2 μm (=0.2(R−0.5P1) shorter, this comparative example was implemented in the same way as the first example.

Under these conditions of the first example to the second comparative example, images recorded on recording targets were checked by visual observation, and whether or not crushing was able to be confirmed in the outlined images and whether or not thickening of the outlined images was able to be confirmed were investigated. Results of this check are listed in Table 1.

TABLE 1

| | Crushing/Expansion Of Outlined Portion |
|---|---|
| First Example | No Crushing |
| Second Example | No Crushing |
| Third Example | No Crushing |
| First Comparative Example | Expansion Observed |
| Second Comparative Example | Crushing Observed |

As understood from Table 1, with respect to the first to third examples, crushing or thickening of the outlined images was unable to be confirmed by visual observation. On the contrary, with respect to the first comparative example, thickening of the outlined image was confirmed by visual observation. In the first comparative example, this thickening of the outlined image was able to be confirmed by visual observation, likely because the conveyance direction end portions of the image dots at the boundary between the colored portion and the non-colored portion were recessed too much from the non-colored portion. Further, in the second comparative example, crushing of the outlined image was confirmed by visual observation. In the second comparative example, this crushing of the outlined image was confirmed by visual observation, likely because reduction of the overlap of the image dots with the non-colored portion was insufficient. From the above, it is understood that by decrease of the X-axis direction widths of image dots each by 0.5(R−0.5P1) or more and 1.5(R−0.5P1) or less, crushing and thickening of the outlined image is able to be made inconspicuous.

FIRST MODIFIED EXAMPLE

Figure 16A:
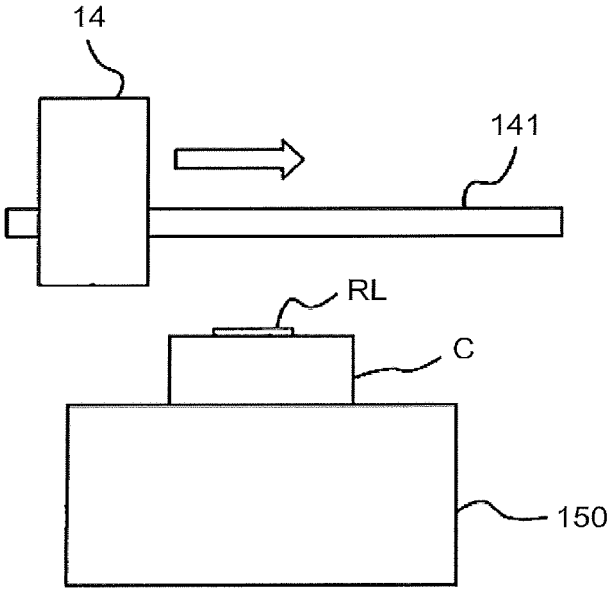
FIG. 16A is a diagram illustrating an example of an image recording system according to a first modified example.
Figure 16B:
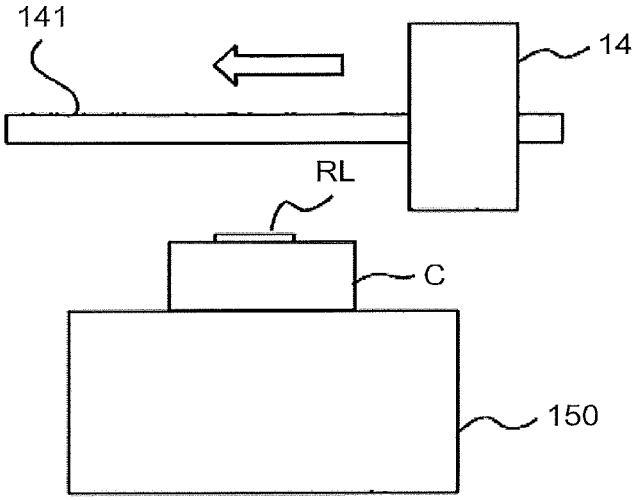
FIG. 16B is a diagram illustrating the example of the image recording system according to the first modified example.

FIG. 16A and FIG. 16B are diagrams illustrating examples of an image recording system 100 according to a first modified example.

In this first modified example, by movement of the recording device 14, an image is recorded on the thermosensitive recording label RL of the container C that is a recording target.

As illustrated in FIG. 16A and FIG. 16B, the image recording system 100 according to this modified example has a placement table 150 where the container C is placed. The recording device 14 is supported by a rail member 141, movably in a left-right direction in the figure.

In this first modified example, firstly, an operator sets the container C on the placement table 150, such that a surface attached with the thermosensitive recording label RL that is the recording target on the container C faces upward. When the container C is set on the placement table 150, image recording processing is started by operation on the operation panel 181. When the image recording processing is started, the recording device 14 positioned at a left side in FIG. 16A moves rightward in the figure, as indicated by an arrow in FIG. 16A. While moving rightward in the figure, the recording device 14 records an image by irradiating the recording target (the thermosensitive recording label RL of the container C) with laser. After recording the image, the recording device 14 positioned at a right side illustrated in FIG. 16B moves leftward in the figure as indicated by an arrow in FIG. 16B and returns to the position illustrated in FIG. 16A.

Further, in the above description, the example where the present invention is applied to the recording device 14 that records an image on the thermosensitive recording label RL pasted on the container C has been described, but for example, the present invention may also be applied to an image rewriting system that rewrites an image on a reversible thermosensitive recording label pasted on the container C. In this case, an erasing device that erases an image recorded on a reversible thermosensitive recording label by irradiating the reversible thermosensitive recording label with laser is provided upstream of the recording device 14 in the conveyance direction of the container C. After the image recorded on the reversible thermosensitive recording label is erased by this erasing device, an image is recorded by the recording device 14. This image rewriting system also enables a boundary between a non-colored portion and a colored portion to be smoothed and crushing of an outlined image to be prevented.

Further, the recording device 14 using a fiber array has been described, but laser emitting elements may be arranged in an array, and an image may be recorded by irradiation of a recording target with laser light from the laser emitting elements without the laser light going through optical fibers. In this image rewriting system also, plural laser emitting element arrays, each of which has 100 to 200 laser emitting elements arranged in an array, are provided, and these laser emitting elements are arranged in a zigzag as illustrated in FIG. 4B or in a layout as illustrated in FIG. 4C. Fabrication of a long laser emitting element array requires processing accuracy for maintenance of linearity of the laser emitting element arrangement and uniformity of the arrangement pitch of the laser emitting elements, and thus becomes expensive. Further, when the number of laser emitting elements is large, there is a disadvantage that the array becomes expensive and the replacement cost upon a breakdown of one of the laser emitting elements becomes expensive. Therefore, the plural provision of the laser emitting element arrays, each of which has 100 to 200 laser emitting elements arranged in an array has the effect of enabling the increase in cost of the device and the increase in cost of replacement to be lessened.

What has been described above is just examples, and each of the following modes has its specific effects.

First Mode

An image recording apparatus that irradiates a recording target with laser light and records an image thereon, the image recording apparatus comprising: a laser irradiation device that has plural laser emitting elements, and irradiates the recording target with laser light emitted from the plural laser emitting elements; an irradiation condition adjusting unit that causes the laser irradiation device to emit laser light such that a part of an image dot recorded on the recording target moving relatively to the laser irradiation device overlaps an image dot adjacent thereto, and that makes a laser irradiation condition for when image dots forming a boundary between a colored portion and a non-colored portion are recorded, different from a laser irradiation condition for when the other image dots are recorded; and an output control unit that controls the irradiation with laser light by the laser irradiation device, based on the laser irradiation condition adjusted by the irradiation condition adjusting unit.

An image dot pitch P2 in a main scanning direction (a Z-axis direction) is determined beforehand according to a structure of the laser irradiation device. Further, laser irradiation timing is controlled such that an image dot pitch in a sub-scanning direction (an X-axis direction) that is a relative movement direction of the recording target also becomes a prescribed pitch. Specifically, control, in which: signals are transmitted at time intervals for when the recording target performs relative movement by amounts that are the same as the pitches; and when image dot recording is performed, the laser emitting elements are turned ON, and when image dot recording is not performed, the laser emitting elements are turned OFF, is executed. These pitches become resolution of an image recordable by the device, and if the resolution is 200 dpi, these pitches are set at about 127 μm.

The image dots recorded on the recording target are approximately elliptical, and when an image dot having a diameter that is the same as the above pitch is recorded on a recording target by the above control, the image dot contacts an image dot adjacent thereto. In this case, a boundary between a colored portion and a non-colored portion is shaped as follows. That is, the boundary between the colored portion and the non-colored portion is formed by a series of outline portions forming the boundary between the colored portion and the non-colored portion, the outline portions being of image dots recorded on this boundary, and when an image dot and an image dot adjacent thereto contact each other, the outline portions of the image dots forming that boundary become semicircular. Therefore, in this case, the boundary between the colored portion and the non-colored portion becomes a jagged shape formed of a series of semicircles, and the most concave portions of the boundary between the colored portion and the non-colored portion are spots where the image dots contact each other, and the height difference in the jaggedness equals the radius of the image dot. As a result, an image large in jaggedness of the boundary between the colored portion and the non-colored portion and poor in appearance is obtained.

Therefore, according to this first mode, a part of an image dot is made to overlap an image dot adjacent thereto. By the overlap of the part of the image dot with the adjacent dot, the boundary between the colored portion formed of a series of image dots and a non-colored portion is shaped as follows. That is, the most concave spot of the boundary between the colored portion and the non-colored portion is a place where the outline portion of one of the image dots intersects the outline portion of the other image dot. As a result, the boundary between the colored portion and the non-colored portion becomes jagged with a series of circular arcs of ranges narrower than that of a semicircle, and the height difference in the jaggedness is decreased. As a result, the boundary between the colored portion and the non-colored portion in the image is able to be smoothed.

As described above, since the image dot pitch in the main scanning direction (Z-axis direction) is determined beforehand according to the configuration of the laser irradiation device, for overlap of a part of an image dot with an image dot adjacent thereto in the main scanning direction, the diameter of the image dots needs to be made larger than the image dot pitch in the main scanning direction (Z-axis direction). However, when the diameter of the image dots is made larger than the pitch, the following problem occurs. That is, if an image dot is larger than the image dot pitch, a part of the image dot overlaps the non-colored portion. As a result, a high-quality image is unable to be formed due to crushing of the outlined image or thickening of the image.

Accordingly, according to the first mode, the laser irradiation condition for when the image dots forming the boundary between the colored portion and the non-colored portion are recorded is made different from a laser irradiation condition for when the other image dots are recorded.

For example, when image dots forming a boundary between a colored portion and a non-colored portion are recorded, the boundary being at an upstream side in the relative movement direction of the recording target, the start timing for start of laser irradiation is delayed from the normal laser start irradiation timing for when the other image dots are recorded. The normal laser irradiation start timing is start timing where a part of an image dot overlaps an image dot adjacent thereto and upstream thereof in the relative movement direction of the recording target. Therefore, if image dots forming a boundary between the colored portion and a non-colored portion are recorded at the normal laser irradiation start timing, the boundary being at an upstream side in the relative movement direction of the recording target, a part of the image dots overlaps the non-colored portion adjacent thereto and upstream thereof in the relative movement direction of the recording target. Therefore, by the delay from the normal laser irradiation timing, the overlap of the image dots with the non-colored portion adjacent thereto and upstream thereof in the relative movement direction of the recording target is prevented.

When image dots are recorded at a boundary between the colored portion and the non-colored portion, the boundary being at a downstream side in the relative movement direction of the recording target, the laser irradiation end timing is made earlier than the normal laser irradiation end timing. The normal laser irradiation end timing for when the other image dots are recorded is end timing where a part of the image dots overlap image dots adjacent thereto and downstream therefrom in the relative movement direction of the recording target. Therefore, if laser irradiation is ended at the normal end timing when image dots are recorded at a boundary between the colored portion and the non-colored portion, the boundary being at a downstream side in the relative movement direction of the recording target, a part of the image dots overlap the non-colored portion adjacent thereto and downstream therefrom in the relative movement direction of the recording target. Therefore, when image dots are recorded at a boundary between the colored portion and the non-colored portion, the boundary being at a downstream side in the relative movement direction of the recording target, by the advancement from the normal laser irradiation end timing, the overlap of the image dots with the non-colored portion adjacent thereto and downstream therefrom in the relative movement direction of the recording target is prevented.

Further, when image dots forming a boundary between a colored portion and a non-colored portion are recorded, the boundary being in a direction orthogonal to the relative movement direction of the recording target, the laser power is made lower than the normal laser power for when the other image dots are recorded. The normal laser power is laser power where a part of the image dots overlaps the image dots adjacent thereto in the direction orthogonal to the relative movement direction of the recording target. Therefore, when image dots forming a boundary between the colored portion and the non-colored portion in the direction orthogonal to the relative movement direction of the recording target are recorded at the normal laser power, a part of the image dots overlap the non-colored portion adjacent thereto in the direction orthogonal to the relative movement direction of the recording target. Thus, laser power for when image dots forming a boundary between a colored portion and a non-colored portion in a direction orthogonal to the relative movement direction of the recording target are recorded, is made lower than the normal laser power, for the image dots to be decreased in size. Thereby, overlap of a part of the image dots with the non-colored portion adjacent thereto in the direction orthogonal to the relative movement direction of the recording target is able to be prevented.

As described above, by use of irradiation conditions preventing overlap of image dots with a non-colored portion through change of laser irradiation conditions, such as laser irradiation timing for when the image dots forming the boundary between the colored portion and the non-colored portion are recorded, and laser power, from normal laser irradiation conditions; image thickening and crushing of an outlined image are prevented, and a high-quality image is able to be recorded.

Second Mode

In the first mode, the irradiation condition adjusting unit makes laser irradiation start timing for when image dots forming a boundary between the colored portion and the non-colored portion are recorded, the boundary being at an upstream side in a relative movement direction of the recording target, later than the laser irradiation start timing for when the other image dots are recorded, and makes laser irradiation end timing for when image dots forming a boundary between the colored portion and the non-colored portion are recorded, the boundary being at a downstream side in the relative movement direction of the recording target, earlier than the laser irradiation end timing for when the other image dots are recorded.

Accordingly, as described with respect to the embodiment, image dots G are prevented from overlapping the non-colored portion in the relative movement direction of the recording target. Thereby, crushing of an outlined image is able to be prevented, and image thickening of a black image is able to be prevented.

Third Mode

In the second mode, the irradiation condition adjusting unit sets, based on a pitch of image dots in the relative movement direction and a radius of the image dots, laser irradiation timing by the laser irradiation device.

As described with respect to the embodiment, the larger the radius R of the image dots is, the larger the amount of overlap with the non-colored portion becomes. Therefore, by setting of the laser irradiation timing based on the relative movement direction pitch P1 of the image dots and the radius of the image dots, the laser irradiation timing enabling the overlap of the image dots with the non-colored portion to be prevented is able to be set appropriately.

Fourth Mode

In the third mode, the irradiation condition adjusting unit sets the laser irradiation timing such that the following relation is satisfied, where the pitch of the image dots in the relative movement direction is P1, the radius of the image dots is R, and an amount of shift of the laser irradiation timing is W:

$$0.5\times(R-0.5P1)\leq W\leq 1.5\times(R-0.5P1).$$

Accordingly, as described with respect to the verification experiments, by the shift of the laser irradiation timing in the range, 0.5×(R−0.5P1)≤W≤1.5×(R−0.5P1), crushing of the outline image and thickening of the outlined image are able to be lessened to levels unrecognizable by visual observation.

Fifth Mode

In the fourth mode, the irradiation condition adjusting unit changes the laser irradiation timing, when power of laser light by the laser irradiation device has been changed.

As described with respect to the embodiment, when the power of laser is changed, the radius R of the image dots is changed, and the shift amount W may no longer satisfy the relation, 0.5×(R−0.5P1)≤W≤1.5×(R−0.5P1). Therefore, by change of the laser irradiation timing when the power of laser is changed, the relation, 0.5×(R−0.5P1)≤W≤1.5×(R−0.5P1) is able to be always satisfied, and crushing of the outline image and thickening of the outlined image are able to be reduced to levels unrecognizable by visual observation.

Sixth Mode

In any one of the second mode to the fifth mode, the irradiation condition adjusting unit sets laser irradiation timing such that the following relation is satisfied, where a pitch of the image dots in the relative movement direction is P2 and the radius of the image dots is R:

$$1.1P2\leq 2R\leq 1.5P2.$$

Accordingly, as described with respect to the embodiment, damage of the recording target by the laser and increase in temperature of the laser emitting elements are able to be reduced, and the boundary between the colored portion and the non-colored portion is able to be smoothed.

Seventh Mode

In any one of the first mode to the sixth mode, the irradiation condition adjusting unit makes power of laser light for when image dots forming a boundary between the colored portion and the non-colored portion in a direction intersecting (orthogonal to) the relative movement direction of the recording target are recorded, lower than power of laser light for when the other image dots are recorded.

Accordingly, as described with respect to the embodiment, image dots recorded as boundary image dots are able to be decreased in size, and the amount of overlap of the image dots with the non-colored portion adjacent thereto in the direction orthogonal to the relative movement direction of the recording target is able to be reduced, the amount being in the direction orthogonal to the relative movement direction of the recording target. Thereby, in the direction orthogonal to the relative movement direction of the recording target, image thickening and crushing of the outlined image are able to be prevented.

Eighth Mode

In the seventh mode, the irradiation condition adjusting unit causes plural image dots to be continuously recorded by continuous lighting of laser light by the laser irradiation device, when an image dot adjacent, in the relative movement direction, to an image dot forming the boundary between the colored portion and the non-colored portion in the direction intersecting (orthogonal to) the relative movement direction is present.

Accordingly, as described with respect to the embodiment, the boundary between the colored portion and the non-colored portion is able to be smoothed in the direction orthogonal to the relative movement direction of the recording target.

Ninth Mode

In any one of the first mode to the eight mode, the non-colored portion is an outlined image.

Accordingly, as described with respect to the embodiment, crushing of the outlined image is able to be prevented, and the edge of the outlined image is able to be shaped smoothly.

Tenth Mode

In any one of the first mode to the ninth mode, the laser irradiation device has: the plural laser emitting elements; plural optical fibers that are provided correspondingly to the plural laser emitting elements and guide laser light emitted from the laser emitting elements, to the recording target; plural laser emitting portions that are included correspondingly to the plural optical fibers and emit laser light; and a laser array that holds the plural laser emitting portions in an array in the predetermined direction.

Accordingly, as described with respect to the embodiment, the laser emitting portions of the optical fibers just need to be arranged at the same pitch as the pixel pitch of the visible image, and the laser emitting elements, such as semiconductor lasers, do not need to be arranged at the same pitch as the pixel pitch. Thereby, the laser emitting elements are able to be arranged to enable heat in the laser emitting element to escape, and increase in temperature of the laser emitting elements is able to be reduced. Thereby, fluctuation of wavelength and optical output of the laser emitting elements is able to be reduced, and a satisfactory image is able to be recorded on a recording target.

Eleventh Mode

In any one of the first mode to the tenth mode, the irradiation condition adjusting unit sets power of laser light emitted from the laser irradiation device, according to temperature of the laser emitting elements.

Accordingly, fluctuation of the optical output according to the temperature of the laser emitting elements is able to be corrected and reduced, and a satisfactory image is able to be recorded on a recording target.

Twelfth Mode

An image recording method executed by an image recording apparatus that irradiates a recording target with laser light and records an image thereon, wherein: the image recording apparatus comprises a laser irradiation device that has plural laser emitting elements and that irradiates the recording target with laser light emitted from the plural laser emitting elements; and the image recording method includes: an irradiation condition adjusting step of causing the laser irradiation device to emit laser light such that a part of an image dot recorded on the recording target moving relatively to the laser irradiation device overlaps an image dot adjacent thereto, and making a laser irradiation condition for when image dots forming a boundary between a colored portion and a non-colored portion are recorded, different from a laser irradiation condition for when the other image dots are recorded; and an output control step of controlling the irradiation with laser light by the laser irradiation device, based on the laser irradiation condition adjusted through the irradiation condition adjusting step.

Accordingly, a boundary between a colored portion and a non-colored portion is able to be smoothed, and crushing of a white image and thickening of the colored portion are able to be prevented.

According to the embodiments, edges of colored portions are able to be smoothed, and image thickening and crushing of outlined images are able to be prevented.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. An image recording apparatus that irradiates a recording target with laser light and records an image thereon, the image recording apparatus comprising:

a laser irradiation device that has plural laser emitting elements, and is configured to irradiate the recording target with laser light emitted from the plural laser emitting elements;

an irradiation condition adjusting unit configured to cause the laser irradiation device to emit laser light such that a part of an image dot recorded on the recording target moving relatively to the laser irradiation device overlaps an image dot adjacent thereto, and make a laser irradiation condition for when image dots forming a boundary between a colored portion and a non-colored portion are recorded, different from a laser irradiation condition for when the other image dots are recorded; and an output control unit configured to control the irradiation with laser light by the laser irradiation device, based on the laser irradiation condition adjusted by the irradiation condition adjusting unit.

2. The image recording apparatus according to claim 1, wherein the irradiation condition adjusting unit makes laser irradiation start timing for when image dots forming a boundary between the colored portion and the non-colored portion are recorded, the boundary being at an upstream side in a relative movement direction of the recording target, later than the laser irradiation start timing for when the other image dots are recorded, and makes laser irradiation end timing for when image dots forming a boundary between the colored portion and the non-colored portion are recorded, the boundary being at a downstream side in the relative movement direction of the recording target, earlier than the laser irradiation end timing for when the other image dots are recorded.

3. The image recording apparatus according to claim 2, wherein the irradiation condition adjusting unit sets, based on a pitch of image dots in the relative movement direction and a radius of the image dots, laser irradiation timing by the laser irradiation device.

4. The image recording apparatus according to claim 3, wherein the irradiation condition adjusting unit sets the laser irradiation timing such that the following relation is satisfied, where the pitch of the image dots in the relative movement direction is P1, the radius of the image dots is R, and an amount of shift of the laser irradiation timing is W:

$$0.5\times(R-0.5P1)\leq W\leq 1.5\times(R-0.5P1).$$

5. The image recording apparatus according to claim 4, wherein the irradiation condition adjusting unit changes the laser irradiation timing, when power of laser light by the laser irradiation device has been changed.

6. The image recording apparatus according to claim 2, wherein the irradiation condition adjusting unit sets laser irradiation timing such that the following relation is satisfied, where a pitch of image dots in the relative movement direction is P2 and a radius of the image dots is R:

$$1.1\leq P2\leq 2R\leq 1.5P2.$$

7. The image recording apparatus according to claim 1, wherein the irradiation condition adjusting unit makes power of laser light for when image dots forming a boundary between the colored portion and the non-colored portion in a direction intersecting the relative movement direction of the recording target are recorded, lower than power of laser light for when the other image dots are recorded.

8. The image recording apparatus according to claim 7, wherein the irradiation condition adjusting unit causes plural image dots to be continuously recorded by continuous lighting of laser light by the laser irradiation device, when an image dot adjacent, in the relative movement direction, to an image dot forming a boundary between the colored portion and the non colored portion in the direction intersecting the relative movement direction is present.

9. The image recording apparatus according to claim 1, wherein the non-colored portion is an outlined image.

10. The image recording apparatus according to claim 1, wherein the laser irradiation device has:

the plural laser emitting elements;

plural optical fibers that are provided correspondingly to the plural laser emitting elements and guide laser light emitted from the laser emitting elements, to the recording target;

plural laser emitting portions that are included correspondingly to the plural optical fibers and emit laser light; and a laser array that holds the plural laser emitting portions in an array in a predetermined direction.

11. The image recording apparatus according to claim 1, wherein the irradiation condition adjusting unit sets power of laser light emitted from the laser irradiation device, according to temperature of the laser emitting elements.

12. An image recording method executed by an image recording apparatus that irradiates a recording target with laser light and records an image thereon, wherein the image recording apparatus comprises:

a laser irradiation device that has plural laser emitting elements, and is configured to irradiate the recording target with laser light emitted from the plural laser emitting elements, and the image recording method includes:

causing the laser irradiation device to emit laser light such that a part of an image dot recorded on the recording target moving relatively to the laser irradiation device overlaps an image dot adjacent thereto, and making a laser irradiation condition for when image dots forming a boundary between a colored portion and a non-colored portion are recorded, different from a laser irradiation condition for when the other image dots are recorded; and controlling the irradiation with laser light by the laser irradiation device, based on the laser irradiation condition adjusted through the irradiation condition adjusting step.

* * * * *